US009135896B2

(12) United States Patent
Rozendaal

(10) Patent No.: US 9,135,896 B2
(45) Date of Patent: Sep. 15, 2015

(54) PEDAL-OPERATED STRINGED MUSICAL INSTRUMENT ACTUATOR APPARATUS

(71) Applicant: Douglas Rozendaal, Clear Lake, IA (US)

(72) Inventor: Douglas Rozendaal, Clear Lake, IA (US)

( * ) Notice: Subject to any disclaimer, the term of this patent is extended or adjusted under 35 U.S.C. 154(b) by 302 days.

(21) Appl. No.: 13/932,399

(22) Filed: Jul. 1, 2013

(65) Prior Publication Data

US 2015/0000502 A1 Jan. 1, 2015

(51) Int. Cl.
*G10D 3/06* (2006.01)

(52) U.S. Cl.
CPC ..... *G10D 3/06* (2013.01)

(58) Field of Classification Search
CPC ..... G10D 3/00; G10D 1/08; G10D 3/143; G10D 3/08; G10D 1/00; G10D 1/12; H03F 3/68; G10F 1/16
USPC ..... 84/317, 312 R, 315
See application file for complete search history.

(56) References Cited

U.S. PATENT DOCUMENTS 3,320,844 A * 5/1967 Lostimolo ..... 84/173
3,603,192 A * 9/1971 Kaar ..... 84/173
3,776,088 A 12/1973 Jones
3,789,722 A 2/1974 Hanes
4,228,718 A 10/1980 Smith
4,545,282 A 10/1985 Arnett et al.
4,593,595 A 6/1986 Rand, Jr.
5,393,925 A 2/1995 Wilson
6,753,466 B1 6/2004 Lee
7,812,233 B1 10/2010 Lee
8,330,034 B2 12/2012 LaBarbera

* cited by examiner

*Primary Examiner* — Kimberly Lockett
(74) *Attorney, Agent, or Firm* — Beem Patent Law Firm

(57) ABSTRACT

A device for depressing the strings of a musical instrument, including a foot-operated pedal portion having a plurality of pedals operatively coupled to a control device, the pedals arranged chromatically and corresponding to major chords; a second foot-operated portion including toggles for modifying the major chords; and a hands-free string-engaging portion operatively coupled to the pedal portion. The string-engaging portion includes a plurality of actuators configured to overlie and depress the strings of the stringed musical instrument. The pedal portion also may include a control device operably coupled to and configured to receive input signals from the pedals and toggles, and the control device may be operably coupled to and configured to send output signals to the actuators, such that depressing one of the pedals causes the actuators corresponding to a predetermined chord to be depressed.

16 Claims, 26 Drawing Sheets

PEDAL-OPERATED STRINGED MUSICAL INSTRUMENT ACTUATOR APPARATUS

BACKGROUND

1. Field of the Invention

This invention relates to an apparatus permitting hands-free actuation of the strings of a stringed instrument, such as a guitar.

2. Background of the Invention

Traditionally, playing stringed instruments such as the guitar, bass, cello, etc., have required that the user use both hands; one to select the notes to play and one to vibrate the strings, by strumming, picking, bowing, etc. Attempts have been made to automate one or both aspects of this process.

For example, U.S. Pat. No. 4,228,718 to Smith discloses a device that depresses the strings of a guitar along the neck. This device requires both a foot pedal and a keyboard portion attached to the guitar in order to play the required notes. In addition, it does not appear to teach how the desired notes are selected by the player.

U.S. Pat. No. 6,753,466 to Day discloses a device that is placed over the neck portion of a guitar. In order to play the guitar, the player strums or picks the strings with one hand while depressing a keyboard portion that picks the desired notes or chords. Thus, both hands still are required to play the instrument. Similar devices are disclosed in U.S. Pat. No. 3,776,088 to Jones, U.S. Pat. No. 4,545,282 to Arnett, et al., U.S. Pat. No. 4,593,595 to Rand, Jr., and U.S. Pat. No. 7,812,233 to Lee.

Conversely, U.S. Pat. No. 5,393,925 to Wilson discloses an apparatus for playing a stringed instrument that completely surrounds or envelopes the instrument. In addition to including multiple fret pokers that push down on the strings, it includes a picker that automatically plucks the guitar strings. As such, the user has no direct interaction with the instrument itself.

What is needed is a stringed instrument-playing apparatus that overcomes the drawbacks described above.

SUMMARY OF THE INVENTION

As described herein, in one aspect, a device for depressing the strings of a stringed musical instrument may include: a foot-operated pedal portion and a hands-free string-engaging portion operatively coupled to the pedal portion. The pedal portion may include a plurality of pedals, each pedal representing a note in a chromatic scale and arranged chromatically with respect to the other pedals. The string-engaging portion may include a plurality of actuators, the actuators arranged so as to overlie a series of half-step positions on each string of the stringed musical instrument. The device may be configured such that depressing one of the pedals causes the actuators corresponding to a predetermined chord to be depressed.

The device also may include a second foot-operated portion, which may include toggle buttons to alter the predetermined chord. The predetermined chord is a major chord and one of the toggle buttons alters the predetermined chord to, e.g., a $7^{th}$ chord or a diminished chord. Toggles effecting other chord modulations such as minor chords and augmented chords are possible.

The pedal portion also may include a control device configured to translate pedal inputs into signals to one or more of the plurality of actuators, which may be, e.g., linear actuators In addition, the pedal portion may include an additional pedal, where the device is configured such that depressing one of the plurality of pedals causes a predetermined set of actuators to be energized and locked in place, and further where the device is configured such that depressing the additional pedal releases the locked actuators.

In another aspect, a device for depressing the strings of a stringed musical instrument may include: a foot-operated pedal portion including a plurality of pedals operatively coupled to a control device, the pedals arranged chromatically, and each pedal representing a major chord; a second foot-operated portion including one or more toggles for modifying the major chords; and a hands-free string-engaging portion operatively coupled to the pedal portion, comprising a plurality of actuators configured to overlie a series of half-step positions on each string of the stringed musical instrument. The device may be configured such that depressing one of the pedals causes the actuators corresponding to a predetermined chord to be depressed. The toggles may permit modification to at least one of a minor chord, a $7^{th}$ chord, a diminished chord, and an augmented chord.

The control device may be a microprocessor or, alternatively, a programmable logic controller. The pedal portion also may include a sensor operatively coupled proximate a proximal end of each of the plurality of pedals. For example, the sensor may be a potentiometer configured to detect a degree to and speed with which a pedal is depressed.

The pedal portion including an additional pedal; wherein the device is configured such that depressing one of the plurality of pedals causes a predetermined set of actuators to be energized and locked in place; and further wherein the device is configured such that depressing the additional pedal releases the locked actuators.

In still another aspect, a device for depressing the strings of a stringed musical instrument may include: a foot-operated pedal portion including a plurality of pedals operatively coupled to a control device, the pedals arranged chromatically, and each pedal corresponding to a major chord; a second foot-operated portion including one or more toggles for modifying the major chords; and a hands-free string-engaging portion operatively coupled to the pedal portion, comprising a plurality of actuators configured to overlie a series of half-step positions on each string of the stringed musical instrument. The pedal portion also may include a control device operably coupled to and configured to receive input signals from the pedals and the one or more toggles, and the control device may be operably coupled to and configured to send output signals to the plurality of actuators, such that the device is configured whereby depressing one of the pedals causes the actuators corresponding to a predetermined chord to be depressed.

These and other features and advantages are evident from the following description of the present invention, with reference to the accompanying drawings.

DETAILED DESCRIPTION OF THE INVENTION

An apparatus 10 permitting foot-controlled operation of a mechanism for depressing one or more strings on a stringed instrument such as a guitar, e.g., along the neck and/or at the frets of the instrument.

Figure 1:
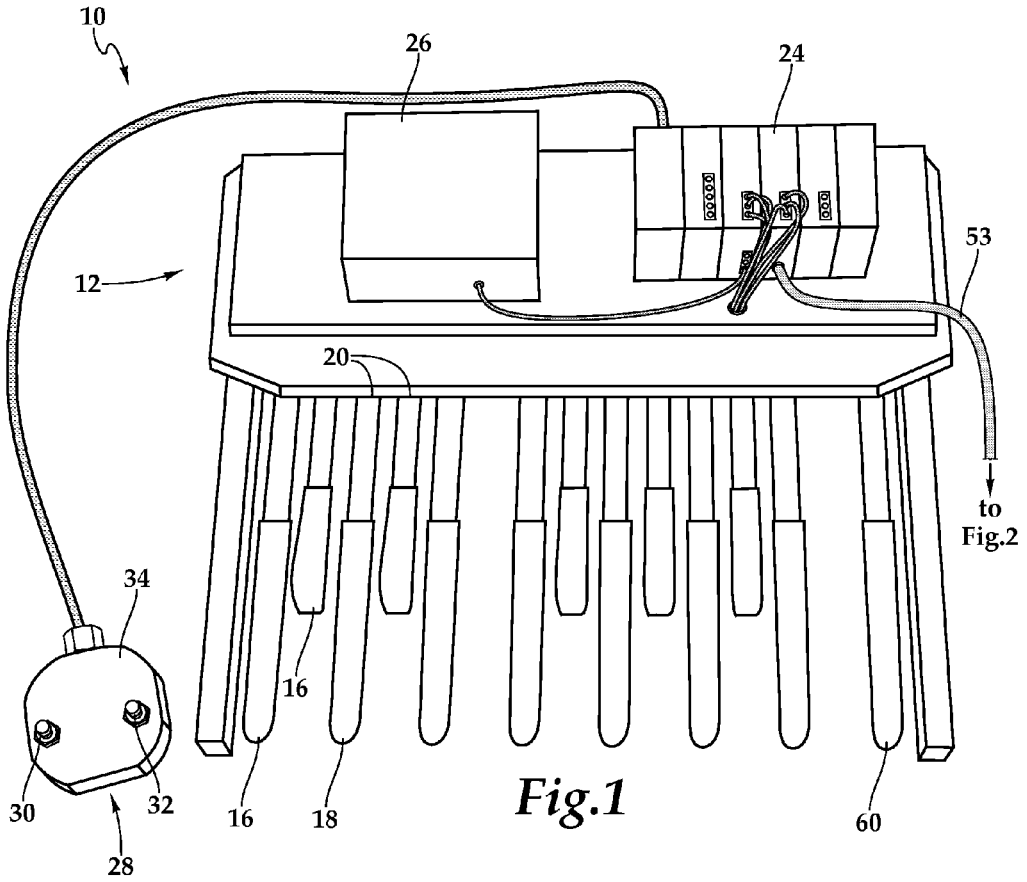
FIG. 1 is a top, perspective view of one embodiment of a series of foot-operated portions used as part of a foot-controlled apparatus for depressing the strings of a musical instrument.
Figure 2:
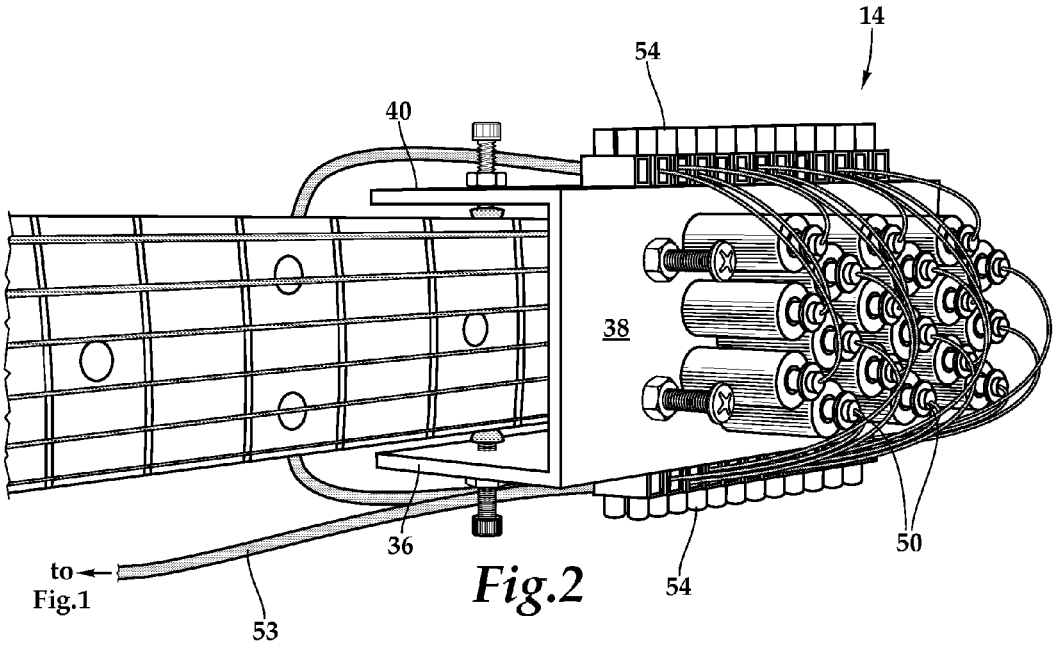
FIG. 2 is a perspective view of a string-engaging portion, mounted on the neck of a guitar, the string-engaging portion being part of a foot-controlled apparatus for depressing the strings of a musical instrument.

Apparatus 10 may include two main components, namely pedal portion 12 and string-engaging portion 14, such as the portions shown in FIGS. 1 and 2, respectively. These two components may be operatively connected so as to permit at least one-way communication from pedal portion 12 to string-engaging portion 14.

Communication may be achieved in one or more ways. In one embodiment, communication may occur via direct electrical or signal-transmitting contact in the form of one or more cables 16, which may be typical copper cabling, optical cables, etc. Cables preferably carry both data and power so as to provide instructions as to which elements on string-engaging portion 14 may be activated and then to drive those elements. In one embodiment, data processing may occur at the pedal portion 12, and each string actuator (described in greater detail below) may have its own power transmission cable or other connection from pedal portion 12, whereby transmission of power across the connection causes the respective actuator to engage or disengage. This situation may be considered as one in which there is no data transmission between pedal portion 12 and string-engaging portion 14 or, alternatively, where power transmission also is considered to be data transmission.

In another embodiment, cables between pedal portion 12 and string-engaging portion 14 may provide data only, while string-engaging portion 14 may draw power from another source, e.g., a separate cable unassociated with pedal portion 12 or a local power source such as a battery.

In still another embodiment, operative connection between pedal portion 12 and string-engaging portion 14 may permit the transmission of data in a wireless fashion, e.g., by the use of a radio wave transmission such as Wi-Fi communication or the BLUETOOTH standard. In this configuration, string-engaging portion still will require power, such as by a separate cable or local power source.

Other types of data communication can be used, as will be understood and appreciated by those skilled in the art.

Turning now to FIG. 1, pedal portion may include a series of pedals 16. Pedals may be arranged chromatically, i.e., in half step intervals. In one embodiment, pedals may span an octave and may begin at C-natural, although a larger or smaller span and a different starting note may be possible. These notes may be "major" notes, i.e., C-natural may correspond to C-natural major or they may correspond to C-natural in the key to which the instrument is tuned.

Each pedal 16 may include a distal end 18 configured to accept a user's foot and a proximal end 20 opposite the distal end. Pedal may rotate about and/or translate at proximal end between a raised or disengaged position and one or more depressed or engaged positions.

Figure 3:
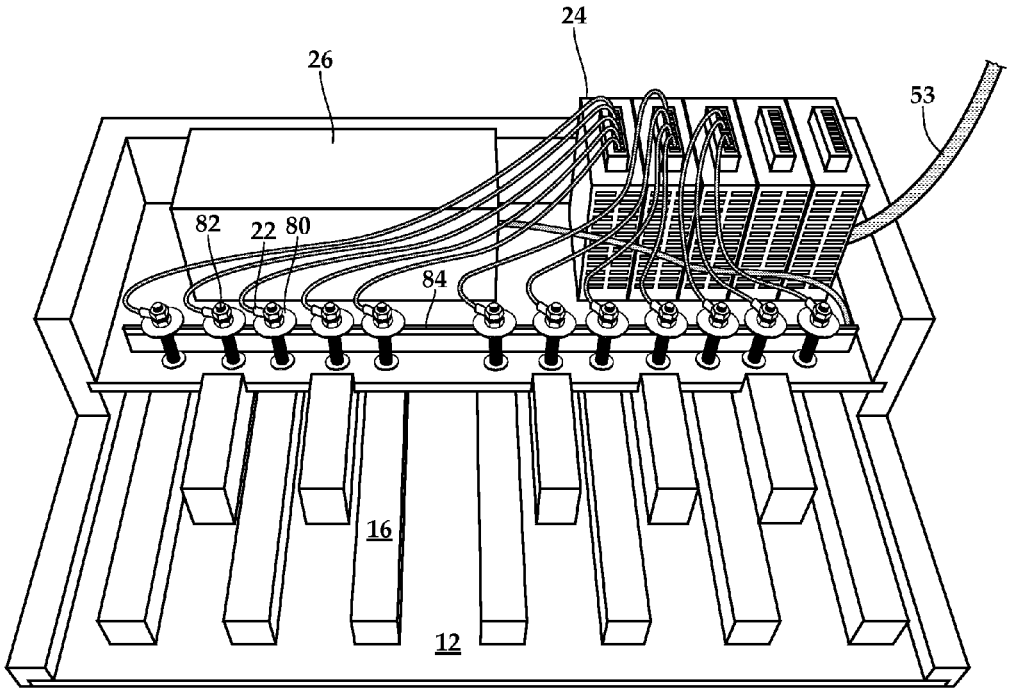
FIG. 3 is a top, perspective view of another embodiment of a series of foot-operated portions.
Figure 4:
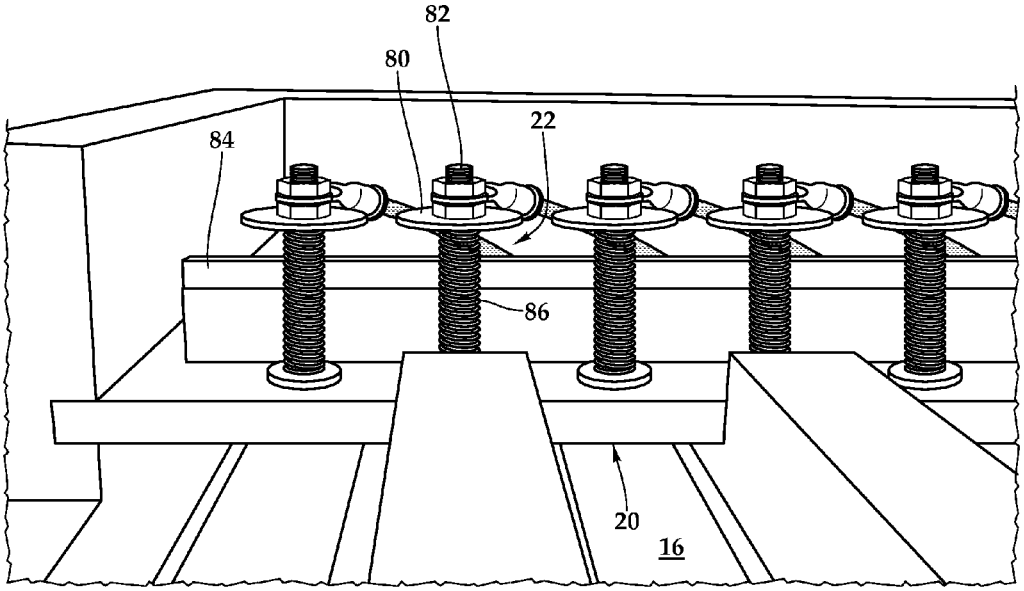
FIG. 4 is a front, perspective view of the triggering mechanism used with the foot-operated portions of FIG. 3.

As seen in the embodiment of FIGS. 3-4, a physical or electrical sensor 22 may operatively engage each pedal proximate each pedal's proximal end. Sensor may be, e.g., an impact sensor or a position sensor. Alternatively, sensor may be a resistance detector such as a potentiometer or strain gauge. The sensor shown in these figures may comprise a contactor 80 configured to move as pedal is depressed. For example, contactor may be operatively coupled to a post 82 that extends through and moves with pedal 16. As pedal 16 is depressed, post 82 and contactor 80 may move until contactor 80 comes into contact with contacting bar 84. Contactor 80 and contacting bar 84 may be electrically conductive, such that contact between them may complete a circuit, thereby sending an instruction to the apparatus indicating that the relevant pedal has been depressed.

Sensor 22 also may include a return mechanism in order to bias sensor back to an original position when pedal is released or after contact has been made with contacting bar 84. In the embodiment of FIGS. 3-4, return mechanism may include a spring such as compression spring 86, which may be disposed around post 82, and which may be operatively coupled to sensor contactor 80. As pedal is depressed, contactor 80 may translate relative to post 82, altering a length of spring 86 and storing potential energy in the spring. When pedal 16 is released, that stored energy may act to return spring 86 to its original configuration, thereby breaking contact between contactor 80 and contacting bar 84. While FIGS. 3-4 illustrate one example of a sensing mechanism, other types of sensors may be employed with apparatus 10.

Sensor may be configured to detect a position of pedal and/or a force with which pedal is depressed. Sensor also may be configured to detect a speed with which pedal is depressed. One or more of these sensed inputs may be converted to a proportional signal sent to string-engaging portion 14 to determine how far to depress strings. Proportional signal preferably is linearly proportional, although logarithmic or other types of proportional signals are possible.

In another embodiment, pedal portion 12 may not include sensors configured to detect motion and/or force of pedal depressions. Instead, depression of pedal at or beyond a certain, predetermined point may complete an electrical circuit, such that the desired chord is triggered and activated completely, regardless of how hard or how far beyond the predetermined point the user depresses the pedal.

Pedals additionally may be operatively coupled to a control device 24. In one embodiment, control device may be a programmable logic controller (PLC). Preferably, however, control device is a microprocessor.

Pedal portion 12 also may contain a power supply 26 providing sufficient power to drive control device and also to drive actuators on string-engaging portion 14. While a larger power supply may deliver increased power to the actuators, which may increase the ability of each actuator to depress and hold a string completely, the larger supply conversely may require the use of larger cables between the power supply and actuators, which may increase the weight and perceived bulkiness of the system.

One example of a suitable power supply is a 24 V supply, such as those that are used to power laptop computers, although other power supplies may be used. Actuators (discussed below) may be selected so as to match power or voltage characteristics of power supply and vice-versa.

As seen in FIG. 1, control device 24 and power supply 26 may be separate components. Alternatively, a PLC may include an integrated power supply that also provides sufficient power to drive string-engaging portion, such as in the embodiment of FIG. 3, which may eliminate the need for an independent power supply.

Depressing a pedal may result in string-engaging portion 14 depressing the strings necessary to play the major chord associated with the pedal, e.g., depressing the "F-sharp" pedal may result in one or more signals being sent to the string-engaging portion to depress the strings necessary to play an F-sharp major chord. In addition to pedals, apparatus 10 may include one or more toggles 28 to modify output generated by depressing pedals. For example, apparatus may include a first toggle 30 that instructs the control device to modify the chord to become a minor chord. Apparatus may include a second toggle 32 that modifies the chord to become a $7^{th}$ chord. Other types of toggles may include major $9^{th}$, $11^{th}$, or $13^{th}$ chords, diminished chords, augmented chords, etc.

It may be possible to select one or more toggles at the same time or in succession. For example, pressing the F-sharp major pedal, followed by the minor toggle and either at the same time or followed by a $7^{th}$ toggle may result in an the instrument playing an F-sharp minor $7^{th}$ chord.

Still further chord variations may be possible, as would be appreciated by those skilled in the art.

Toggles 28 may be integrated into pedal portion 12, e.g., grouped together but spaced from chord pedals 16. Alternatively, toggles may be separate from pedal portion in a second foot-controlled portion 34, which may provide the user with the flexibility to place toggles in a position comfortably controllable by the user's other foot. Since toggles may vary between an "on" position and an "off" position, toggles may not be coupled to sensors configured to determine a relative position of toggles. Instead, toggles may be depressible switches. Toggles, like pedals, preferably are spaced apart from one another a suitable distance reducing a likelihood of the user inadvertently depressing more than one toggle or pedal at the same time.

Control device 24 is configured to receive signals from pedals, process them, and send output signals to string-engaging portion 14. Examples of this processing are discussed in greater detail below.

Figure 5:
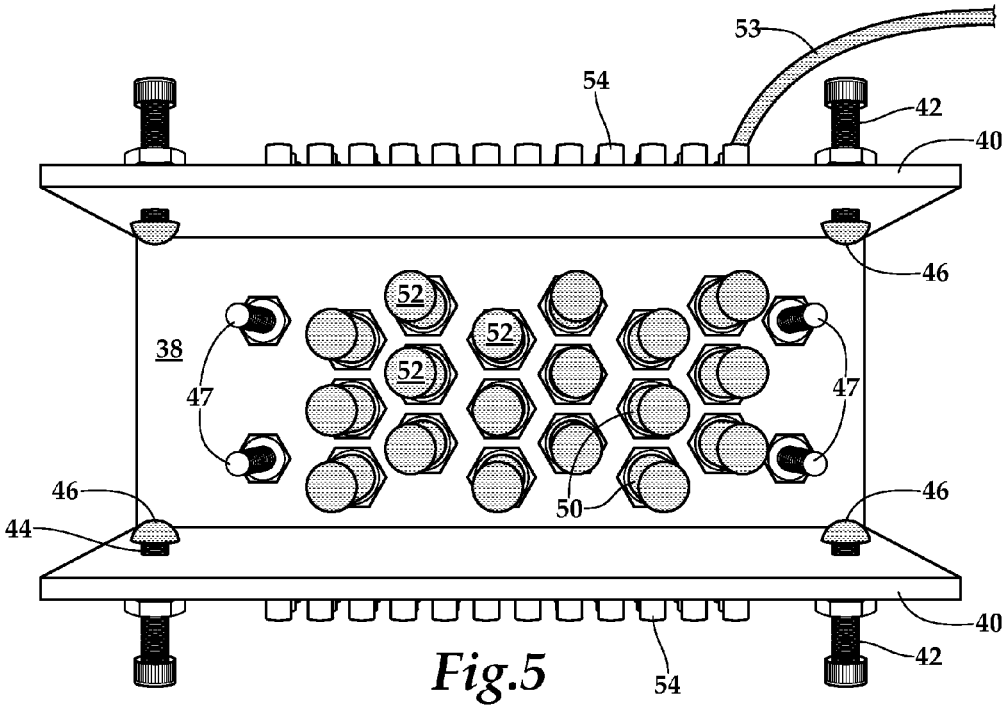
FIG. 5 is an end, perspective view of the string-engaging portion of FIG. 2.
Figure 6:
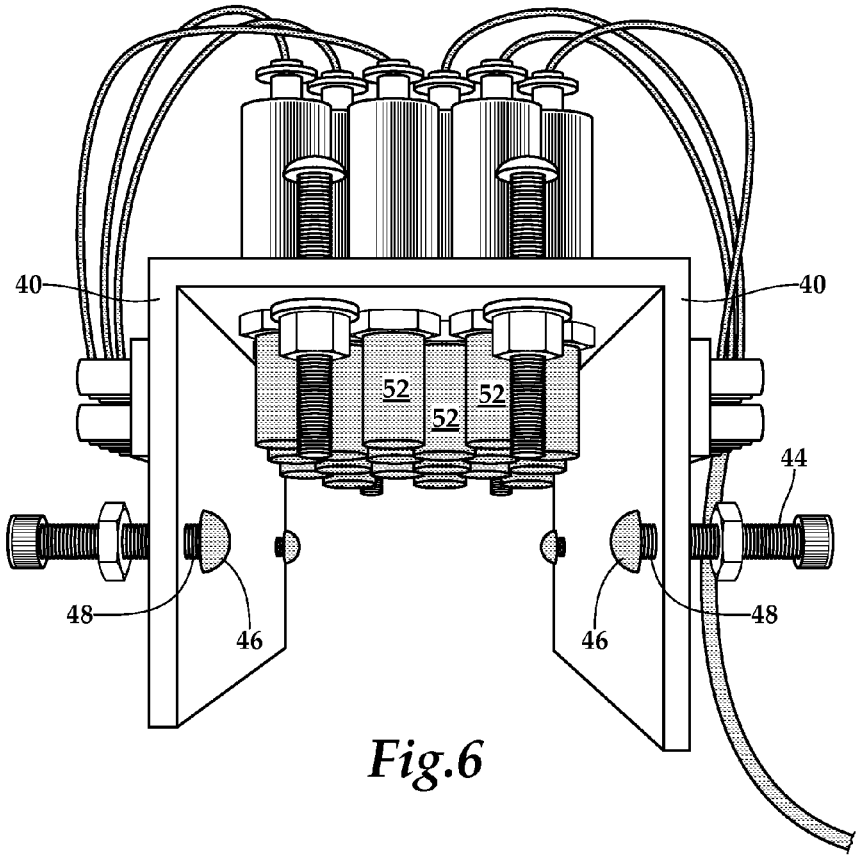
FIG. 6 is a bottom view of the string-engaging portion of FIG. 2.
Figure 7:
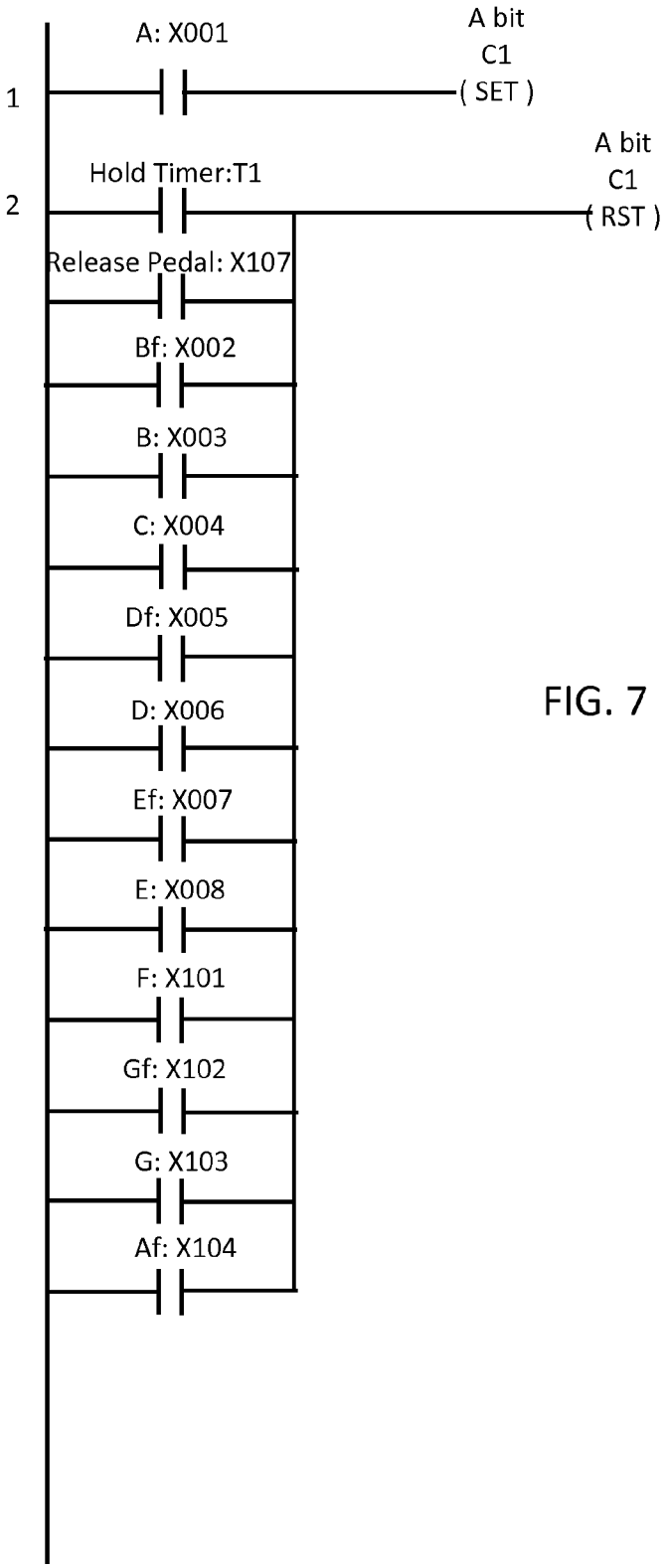
FIGS. 7-29 are examples of one type of logic that may be used to coordinate a user's pedal and/or toggle choices with depression of various strings of the instrument.
Figure 8:
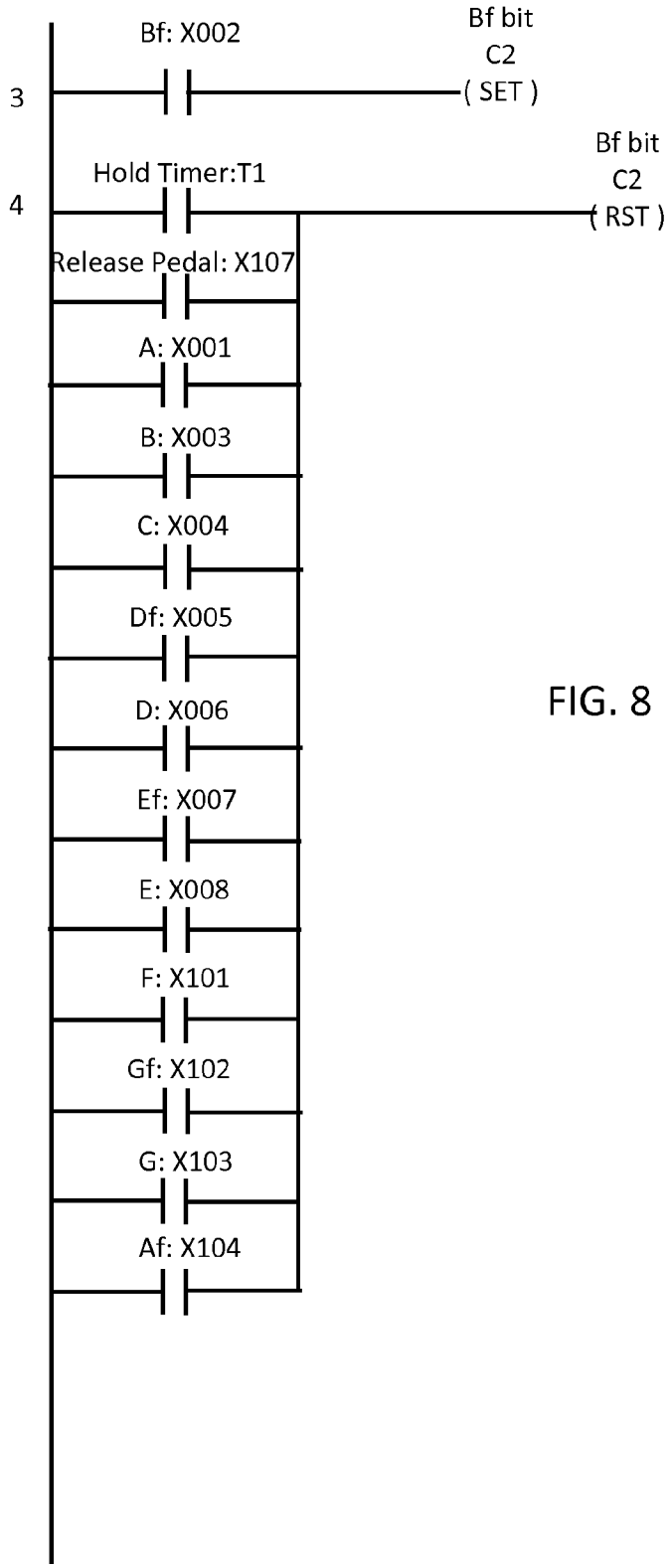
Figure 9:
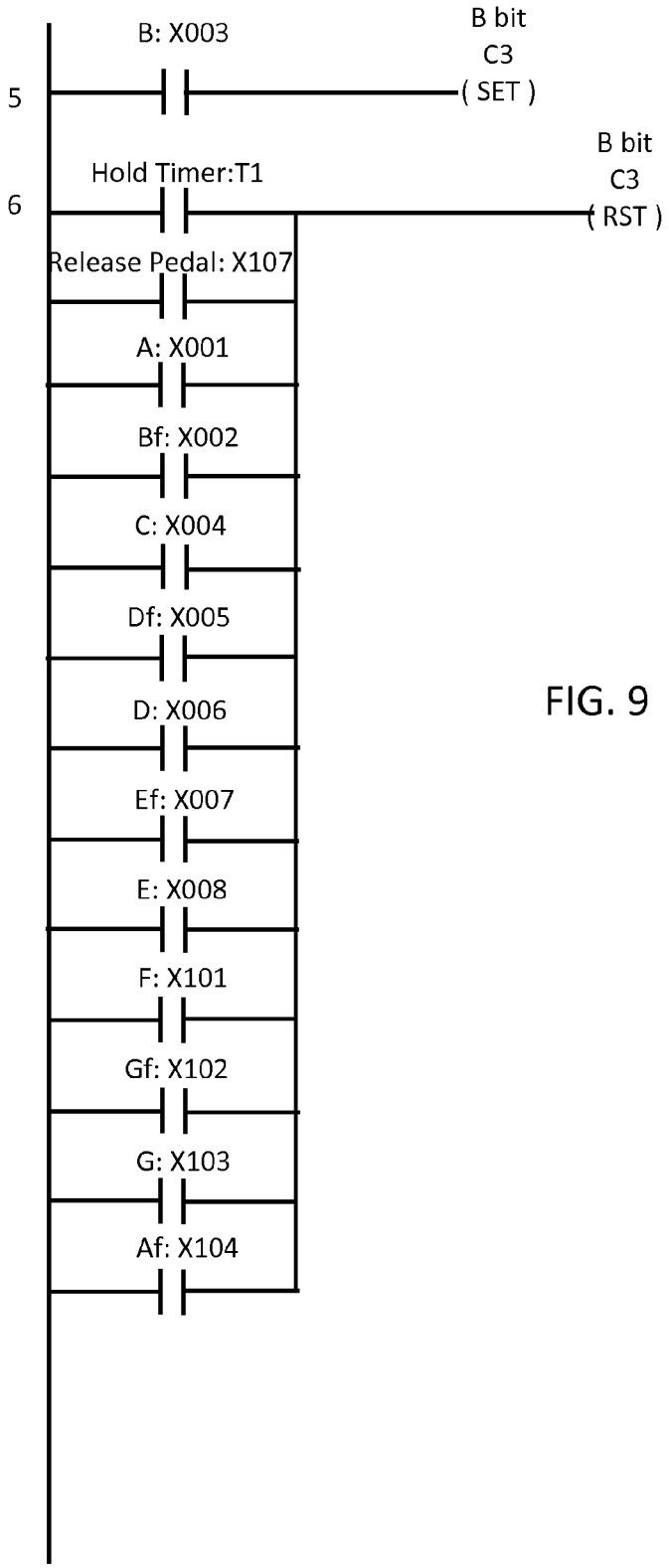
Figure 10:
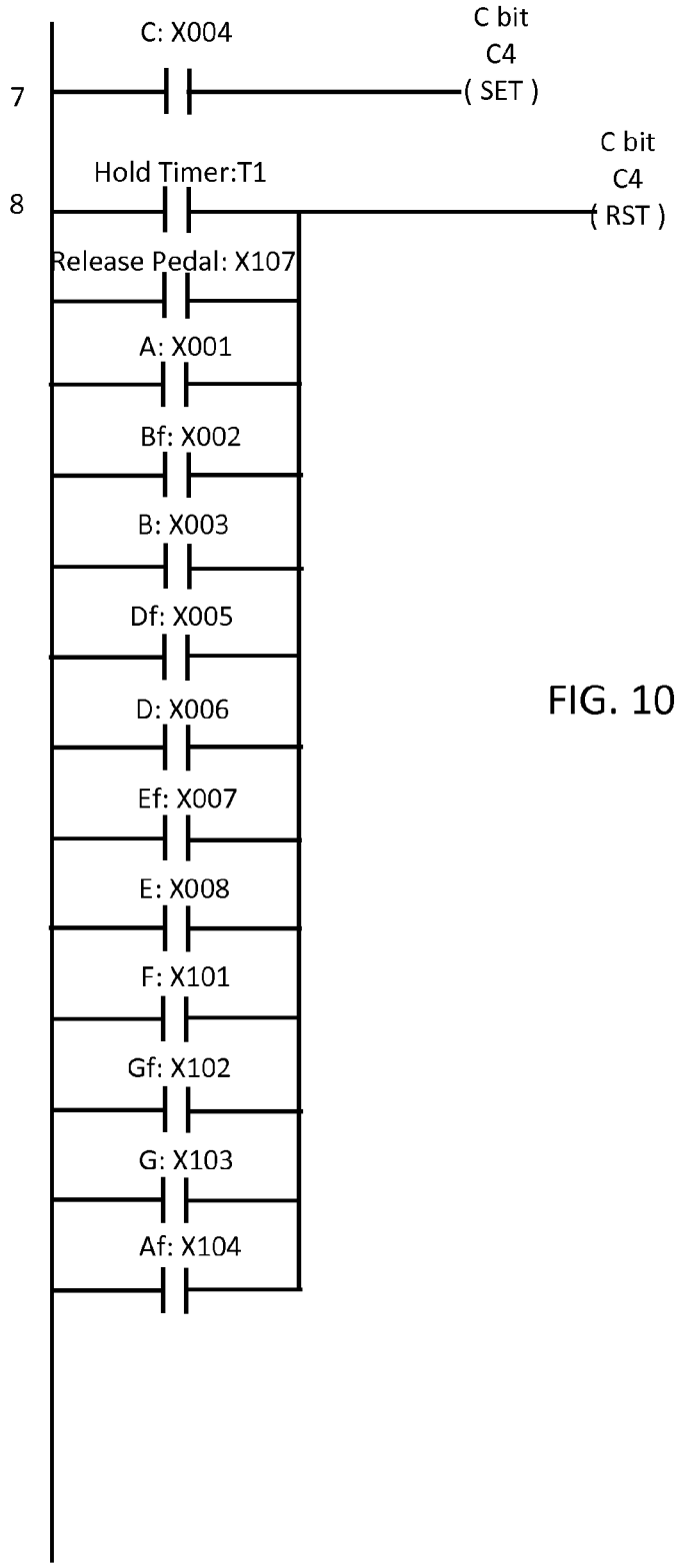
Figure 11:
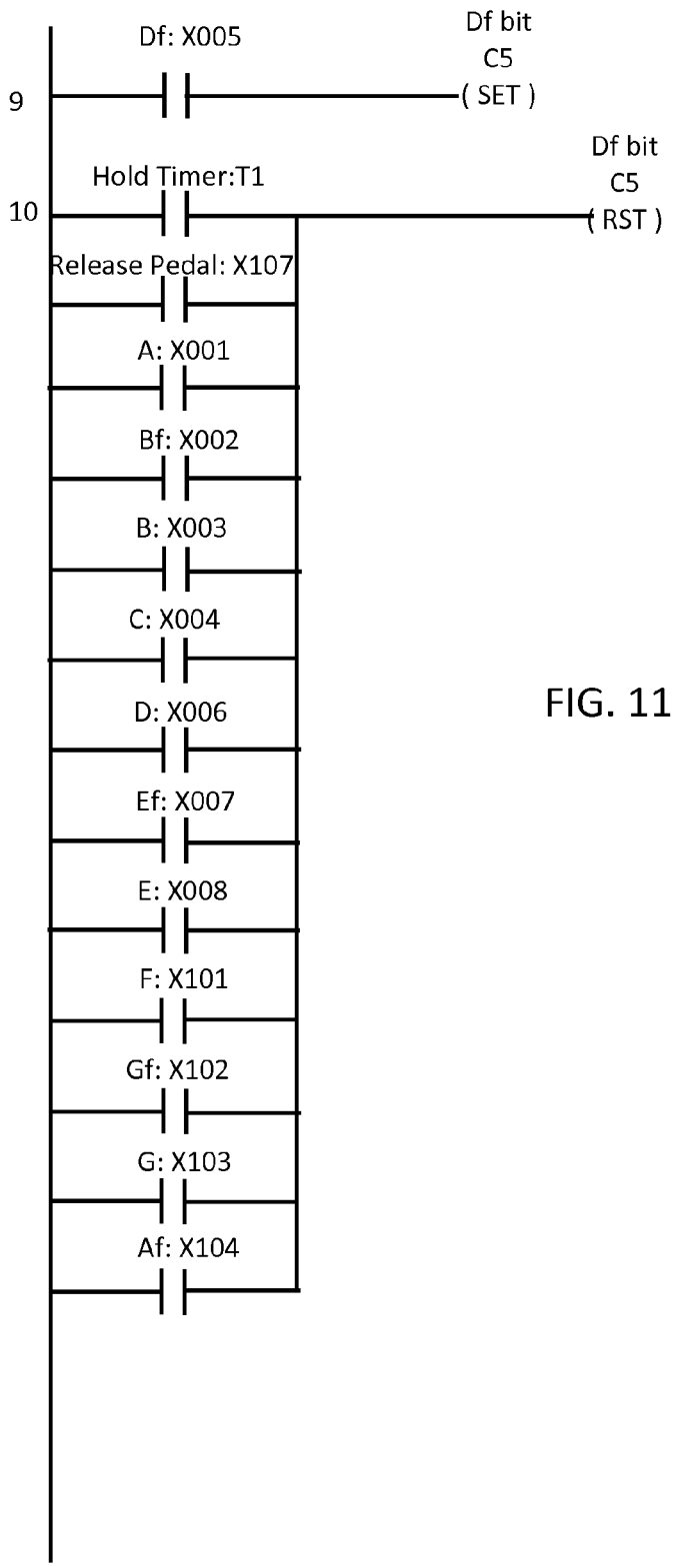
Figure 12:
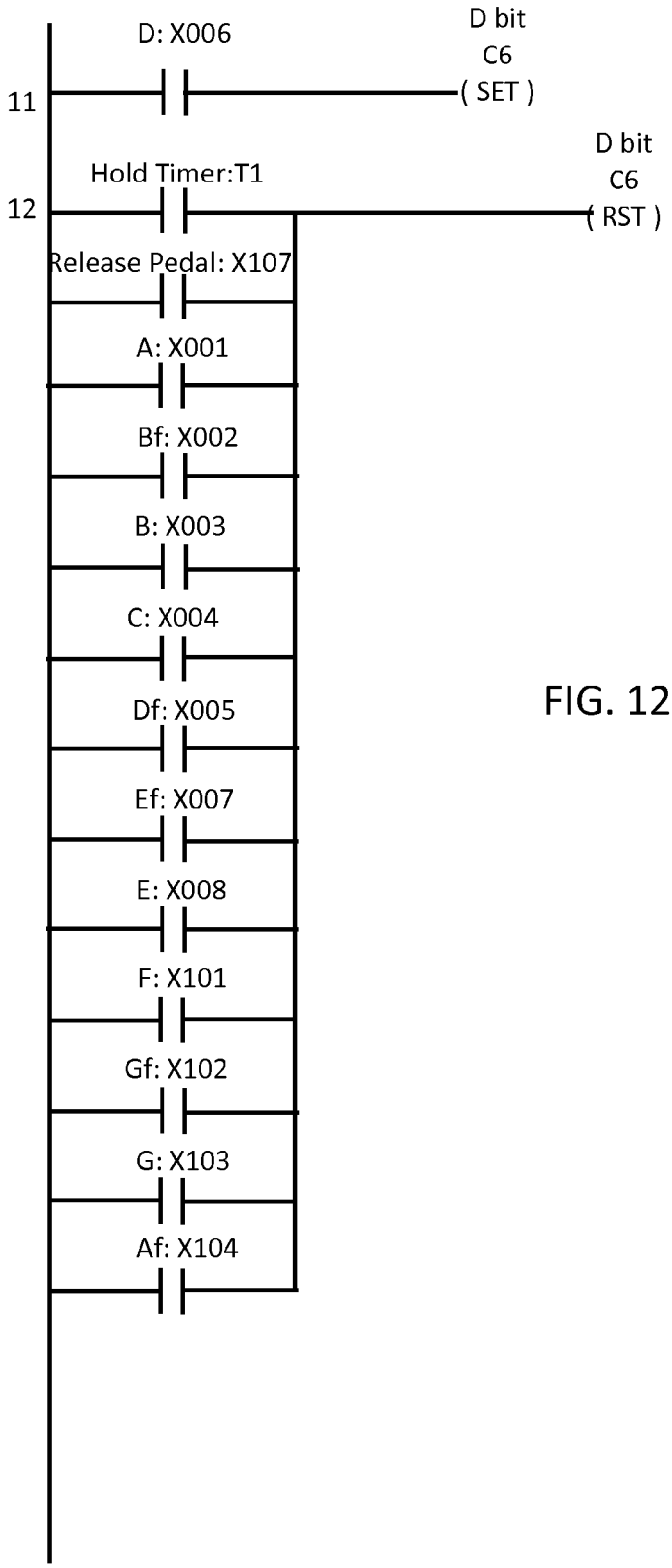
Figure 13:
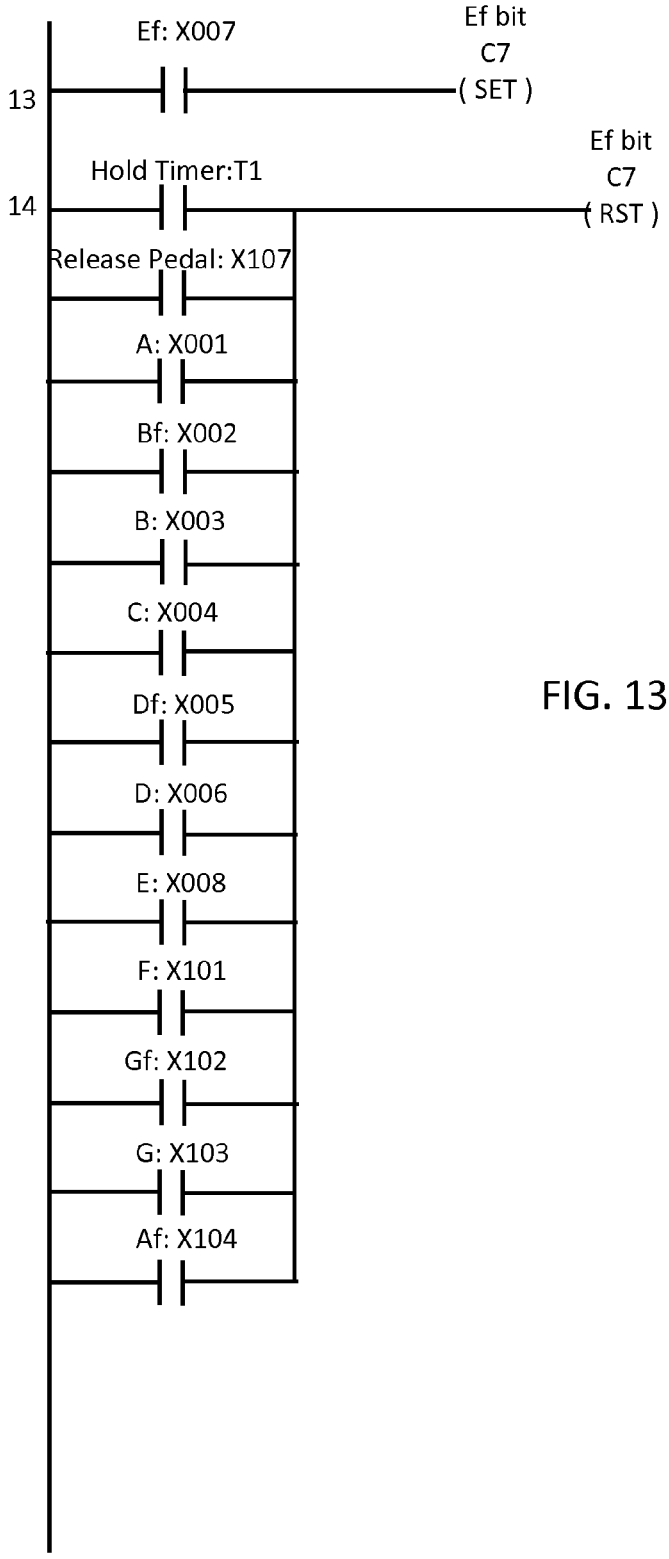
Figure 14:
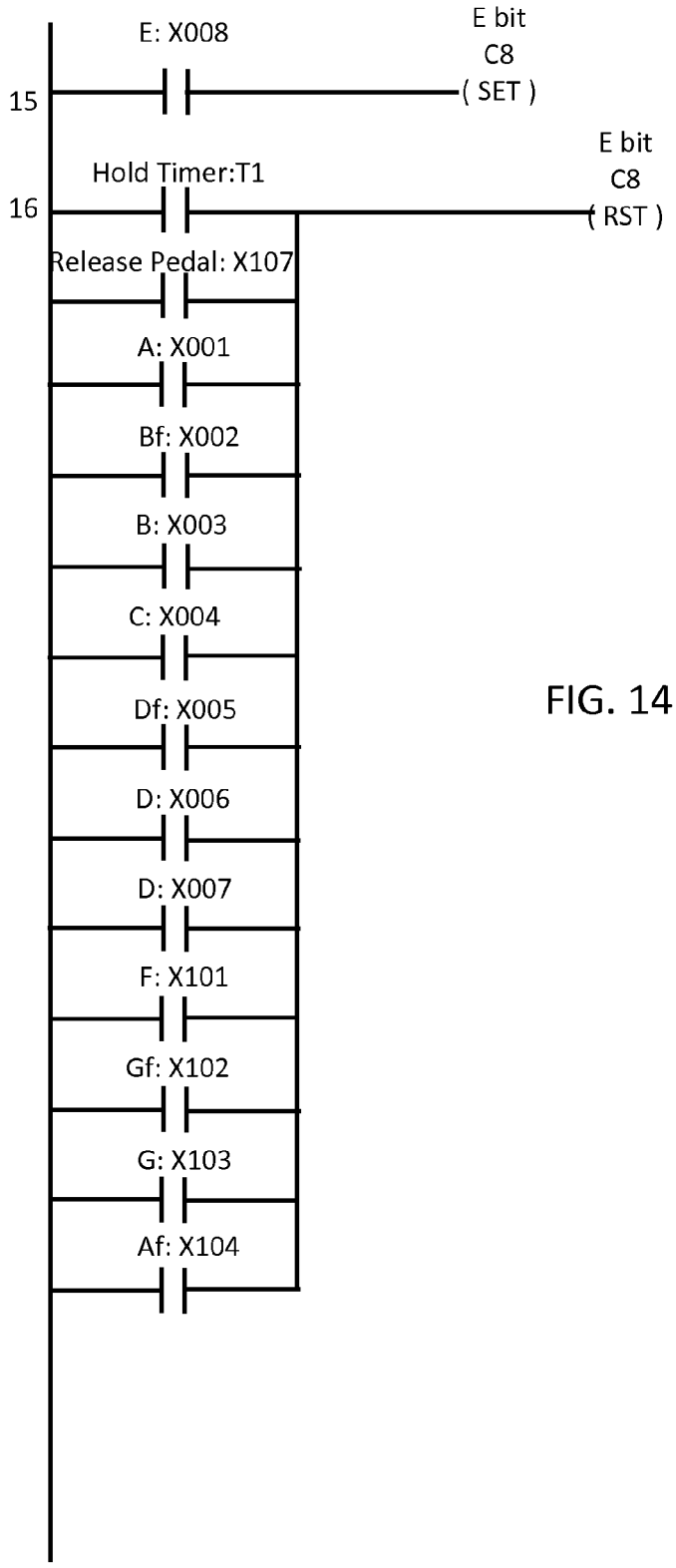
Figure 15:
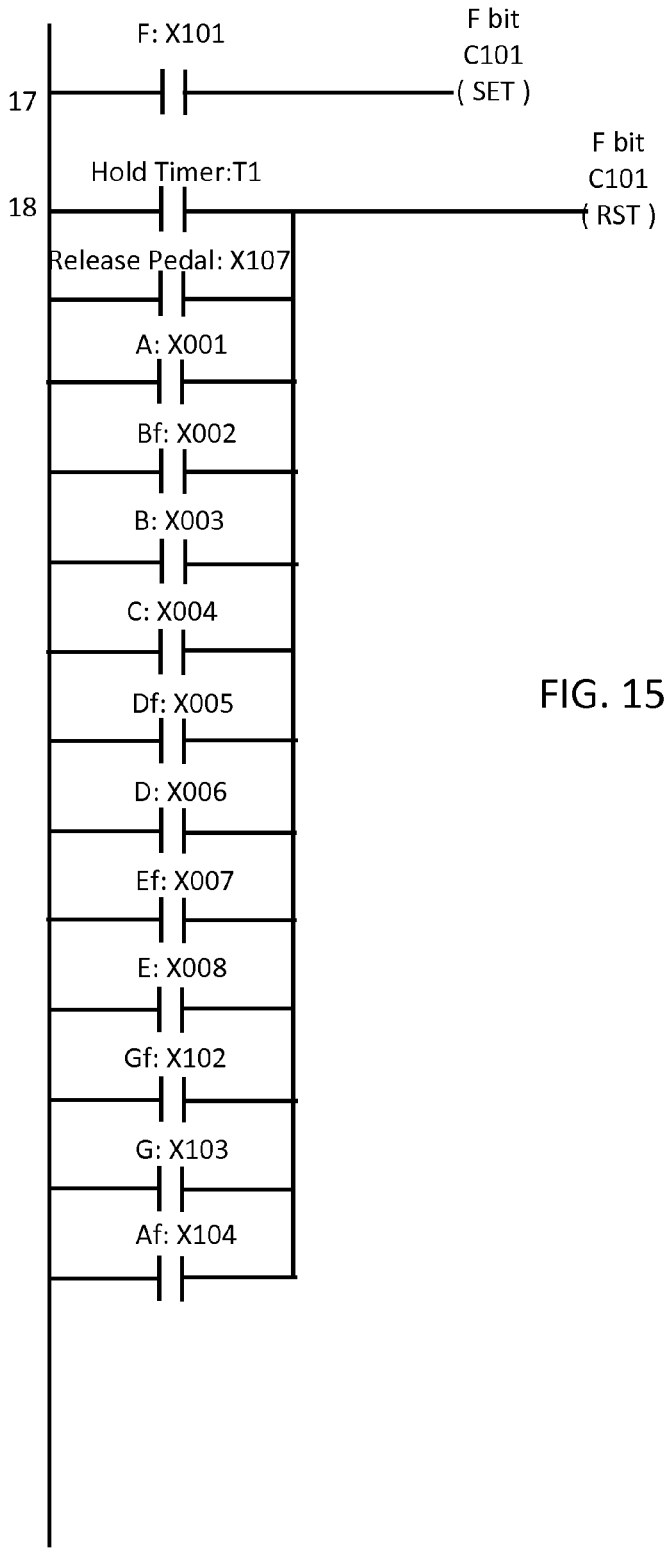
Figure 16:
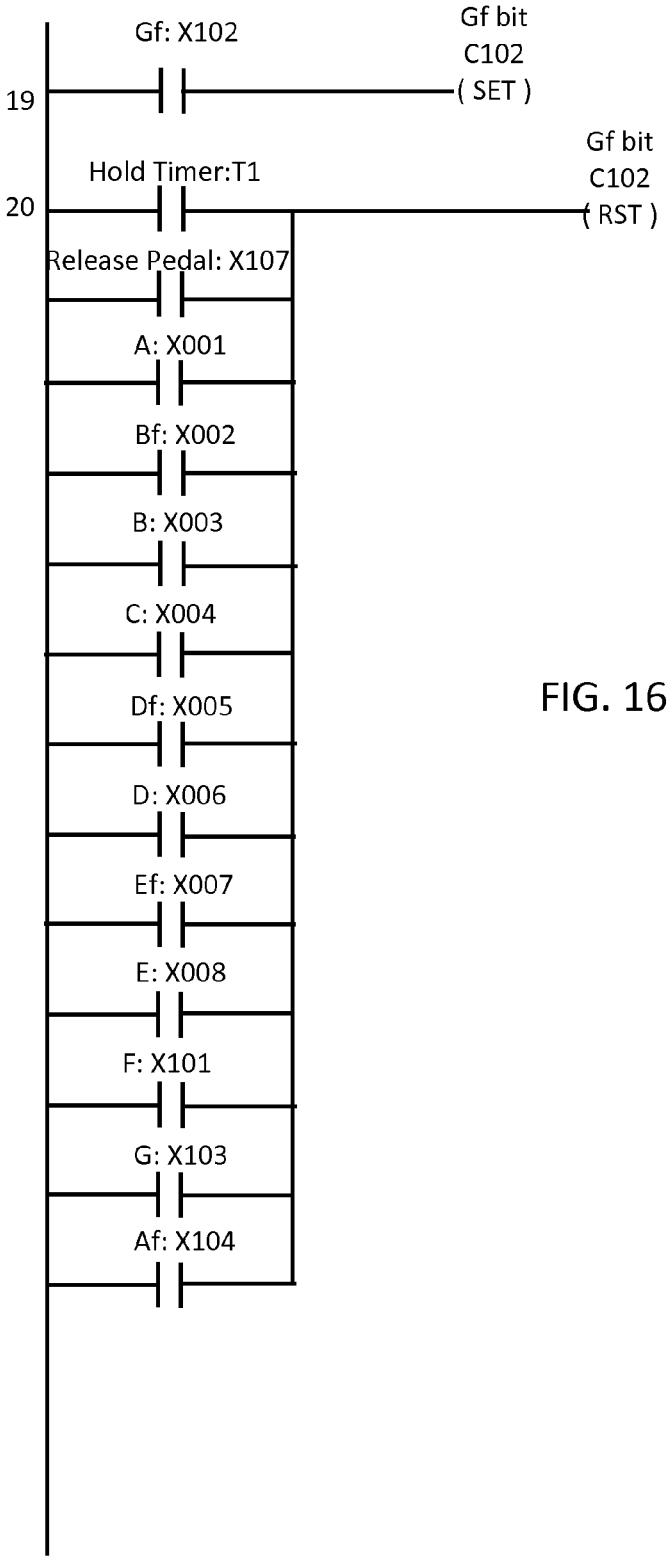
Figure 17:
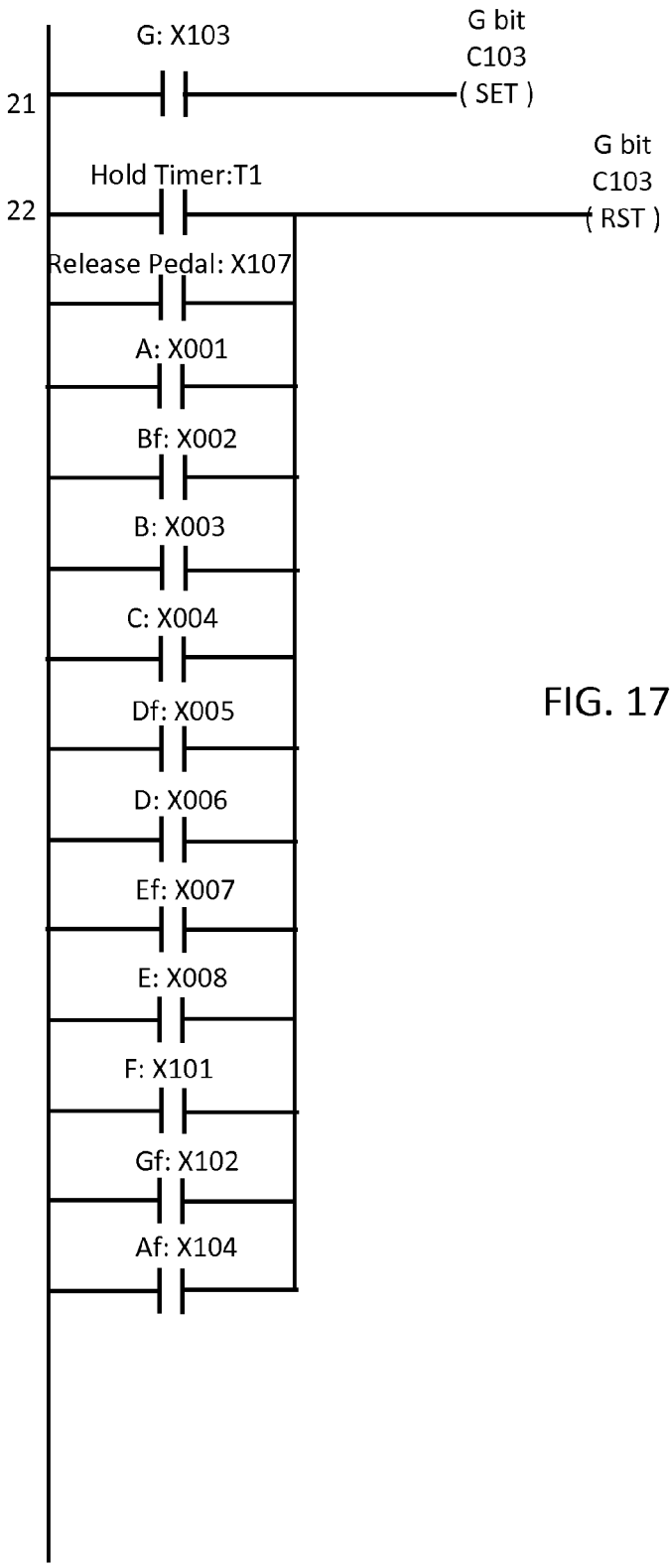

Turning now to FIGS. 2 and 5-6, string-engaging portion 14 may include a housing 36 with a first portion 38 configured to overlie at least a portion of a neck of a stringed instrument, such as a guitar, bass, cello, etc. Housing 36 also may include a plurality of side portions 40, which may depend downward from first portion. For example, housing may include a side portion on each side of instrument neck, each side portion depending downward from the first portion to a position below string-contacting surface of neck.

Apparatus may be configured, via one or more retaining members 42, to retain housing 36 in a substantially fixed location with respect to the instrument neck. In one embodiment, this may be accomplished by configuring housing 36 to substantially envelop one or more cross-sections of neck, e.g., by including first portion 38 above strings, side portions 40, and one or more additional portions configured to abut an underside of neck. These additional portions may not span an entire width of the neck, but they may span enough of it so as to provide one or more shoulders against which neck may abut, preventing movement of housing perpendicular to a length of neck.

Additionally or alternatively, retaining members may comprise one or more clamping members 44. Clamping members may include a contacting portion 46 configured to press against side and/or underside of neck. Clamping members may comprise a resilient material such as a rubberized or plasticized material, which may permit increased frictional engagement between clamping member and neck, while also minimizing scratches or other damage to neck.

As seen in the comparison of FIGS. 2 & 6, clamping members may be configured to be generally parallel to neck portion when string-engaging portion is installed as intended. When installed, first portion 38 of string-engaging portion may be spaced from neck in order to provide sufficient clearance for strings, while ensuring that strings may be depressed fully. A distance between first portion 38 and neck may be determined based on the type and characteristics of actuators that are used, because it may be important for actuator to bottom out when actuated fully, thereby depressing strings fully.

In one aspect, string-engaging portion 14 may include one or more standoffs 47 extending downward from first portion 38 towards neck. Standoffs may be sized so as to permit full depression of actuators and, by extension, full depression of strings while at the same time, not locating first portion 38 so close that actuators experience unacceptable levels of back loading. Standoffs may be positioned between strings and may be sized so as to prevent reverberation of strings when instrument is played. Standoffs may be adjustable, e.g., by including a threaded portion configured to engage first portion 38, which may allow the user to adjust a length of standoff, e.g., to account for higher pitched strings being thinner than lower pitched strings.

Clamping members may be spring-loaded and may have an inwardly disposed initial configuration, such that placing neck within housing may force clamping member outward, causing a resistive spring force to be applied inward against neck. Alternatively, one or more clamping members may include a threaded portion 48, by which clamping member 44 may be selectively moved inward or outward, permitting the user to determine how much force to apply in order to achieve the desired level of engagement with neck.

One clamping member may be substantially fixed in position relative to a side portion 40, such that clamping member on a side of neck opposite this one clamping member may be used to secure string-engaging portion 14. Preferably, however, clamping members proximate their respective side portions each are adjustable, which may provide the user with increased flexibility in positioning string-engaging portion over neck in a proper location to ensure that the proper strings are depressed when pedals are activated.

Returning to FIGS. 2 and 5-6, string-engaging portion 14 may include one or more electrical actuators 50 configured to depress strings. Actuators may be configured to move up and down, i.e., generally perpendicular to neck, in response to signals received from control device 24. As best seen in FIGS. 5-6, one or more of actuators 50 also may include a pad 52 disposed at a distal end of actuator 50 and configured to engage instrument strings.

In one embodiment, actuator 50 may be a plunger disposed within a solenoid. In another embodiment, actuator 50 is a linear actuator. Linear actuators may be preferable to solenoids, which may have a logarithmic relationship between travel distance and input force of a solenoid. In comparison, the linear actuator may be more receptive or responsive to changing its displacement distance in response to varying input forces on pedals 16.

String-engaging portion may include one actuator for each half-step note position for each string. For example, in the case of an apparatus 10 configured to be used with a traditional six-string guitar, string-engaging portion may include six actuators disposed in a row and spaced from adjacent rows a distance substantially equal to the distance between guitar frets. In the case of a four-string bass guitar, apparatus may include four actuators disposed in a row.

In another embodiment, such as the embodiment of FIGS. 5-6, a housing holding the moveable element of each actuator may have a width preventing side-by-side placement of actuators for every string. For example, in one instrument, strings may be about ¼" apart, and each solenoid plunger and/or housing may have an outside diameter of about ½", which may leave no or insufficient clearance between actuators on adjacent strings. In this case, adjacent actuators may be staggered, e.g., into two alternating rows of 3 actuators each for each fret on the instrument. Preferably, both rows in the pairing are spaced within the same fret so as to not affect a pitch of a resulting chord. As can be seen in FIG. 5, there may be a space between groups of actuators, which may correspond to the location of fret bars on the instrument being played.

In still another embodiment, apparatus 10 may include a toggle switch, softkey, selector knob, etc., for the user to select the type of instrument being used. Selector may engage the actuators corresponding to the appropriate number and location of strings, whereas the remaining actuators may be disabled and may be configured to not move when a pedal is depressed. In one aspect, control device may include hardware or software configured to provide the appropriate actuator outputs for a selected musical instrument. Selecting a certain instrument may send a signal to the control device to use the instructions for that instrument in order to control the appropriate actuators when a pedal is depressed.

Additionally or alternatively, system 10 may include interchangeable string engaging portions 14 with different numbers and/or arrangements of actuators. For example a bass guitar string engaging portion may include rows of four actuators or sets of 2×2 actuator pairs for each fret to reflect the fact that the bass guitar in question has four strings instead of six.

As discussed above, actuators may be operatively coupled to control device 24 and power supply 26 in order to receive signals to engage and/or disengage actuators to thereby play the desired chords. In the embodiment shown in FIGS. 1-2, actuators may be electrically coupled to control device via one or more cables 53, and hot, neutral, and/or ground wires may connect to actuators so as to engage actuators when power is sent to the actuator via the wires. In one embodiment, these wires may connect directly to pedal portion 12, e.g., by soldering to electrical contacts on one or both of actuators and pedal portion. Preferably, however, wires may form connections at one or more terminal blocks or strips 54. FIG. 2 illustrates one example of a terminal block installation, in which a block or series of blocks on one side of string engaging portion includes connections for a common ground and a block or blocks on another side of string engaging portion includes connections to connect hot wires from actuators with power wire or wires coming from power supply.

In another embodiment, wires coming from pedal portion may terminate at a circuit board disposed on string engaging portion 14, which also may serve as a terminus for wires electrically coupled to each of the actuators. In this embodiment, inputs may be transmitted to circuit board, which then may process inputs and determine which actuators to actuate. Because the logic controlling apparatus 10 may be disposed on string engaging portion 14, fewer wires may be necessary to couple string engaging portion 14 with pedal portion 12, thereby resulting in a more compact, less bulky device.

In addition to signal carrying wires, a power wire, connected either to pedal portion 12 or to a separate power supply, also may connect to terminal strips 54, thereby providing power. In this configuration, it may be possible to separate power wire from string-engaging portion, e.g., in case it is necessary to replace all or part of string-engaging portion 14.

In one aspect, apparatus 10 may be configured to couple to a traditional six string guitar to enable the user to play rhythm guitar, as opposed to lead guitar. Because it is possible to play all major chords and most other chords using four consecutive frets of a guitar, string-engaging portion 14 may include actuators that span four frets. String-engaging portion 14 may be adjustable to be positioned and coupled at multiple positions along neck, such that four adjacent frets are not necessarily the first four frets on the neck proximate the head stock. In this way, string-engaging portion may permit the transposition of chords, similar to how a capo may be used to change the tuning of the guitar.

In addition or as an alternative to the ability to change a pitch of the chords being played by modifying the position of the string engaging portion relative to the neck of the instrument, apparatus 10 may include other pitch modification means such as a transposition knob or other switch. In one example, transposition switch may include a knob with an indicator such as an arrow or other protrusion or a window that reveals the selected reference. Indicator may point to a reference to indicate the type of pitch modification, if any, that should occur. For example, references may a gradation or scale such as −2, 1, 0, +1, +2, etc. When "0" is selected, the chord selected by the user may be the same chord output to the string engaging portion, e.g., hitting the "C" pedal may result in the actuators for the C-major chord being triggered.

Conversely, when the +1 indicator is selected, a signal may be sent to control device 24 to create an output corresponding to one-half step higher than the selected chords. Thus, hitting the "C" pedal may result in the actuators for a C#-major chord being activated. This transposition may continue until the user returns the dial to the "0" selection or moves it to a different setting, resulting in a different transposition.

Apparatus may include a chord latching feature that remembers the last chord selected by the user and keeps the respective electrical actuators engaged. In one aspect, this feature may remain energized as long as the user keeps the desired pedal depressed. Preferably, however, it may be energized if the user's foot is not on a pedal. For example, it may be a timed element, whereby depressing a pedal may keep that chord locked for a predetermined period of time, e.g., about 3 seconds. If the user keeps his foot on a pedal, the chord latching timer may continually reset itself until the user removes his foot from the pedal, at which point, the timer will begin to count down.

In still another aspect, chord latching may occur until it is released by the user or until the user selects another pedal to play another chord.

Returning to FIG. 1, pedal portion 12 may include an additional pedal 60, toggle, etc., in order to release the chord latching feature. Depressing one of pedals 16 may cause information relating to that chord to be stored in memory and/or to cause control device 24 to send signals to the appropriate actuators to remain energized. Conversely, depressing pedal 60 may send a signal to control device 24 to clear the memory, to stop sending signals to the energized actuators, and/or to send signals to the actuators to deactivate.

Control device 24 may be pre-programmed in one or more ways in order to convert input pedal and/or toggle selections into activation of one or more actuators. Each possible pedal-toggle combination may correspond to a predetermined series of activated actuators. These combinations may be stored in a table. Upon receiving a signal from the depressed pedal and/or toggle, control device 24 may perform a table lookup to determine which actuators correspond to the selection and may send a signal to those actuators to engage. This option may be preferred if control device 24 is a microprocessor, although other control options are possible.

In another aspect, control device may include programmed, rule-based instructions which may be stored in one or more languages readable and executable by the control device. This option may be preferred if control device 24 is a programmable logic controller, although other control options are possible. One exemplary programming language may be ladder logic, and an example of this logic may be shown in FIGS. 7-29.

In these figures, the rail of the left rung of the ladder may correspond to power, the right rail corresponds to actions or outputs, and the steps in between correspond to possible pathways to achieve the respective actions or outputs.

For example, in entry "1," depressing the "A" pedal energizes bit C1 in the PLC's memory. In entry "2," depressing latch release pedal 60 or any other pedal 12 resets bit C1. Similarly, in entry "3," depressing the B-flat pedal energizes bit C2, while depressing latch release pedal 60 or any other pedal 12 then will reset bit C2, as at entry "4." Similar logic may be implemented for the remaining pedals/notes, as seen in entries "5" through "24," i.e., energizing or releasing bits C3, C4, C5, C6, C7, C8, C101, C102, C103, and C104, respectively.

Figure 18:
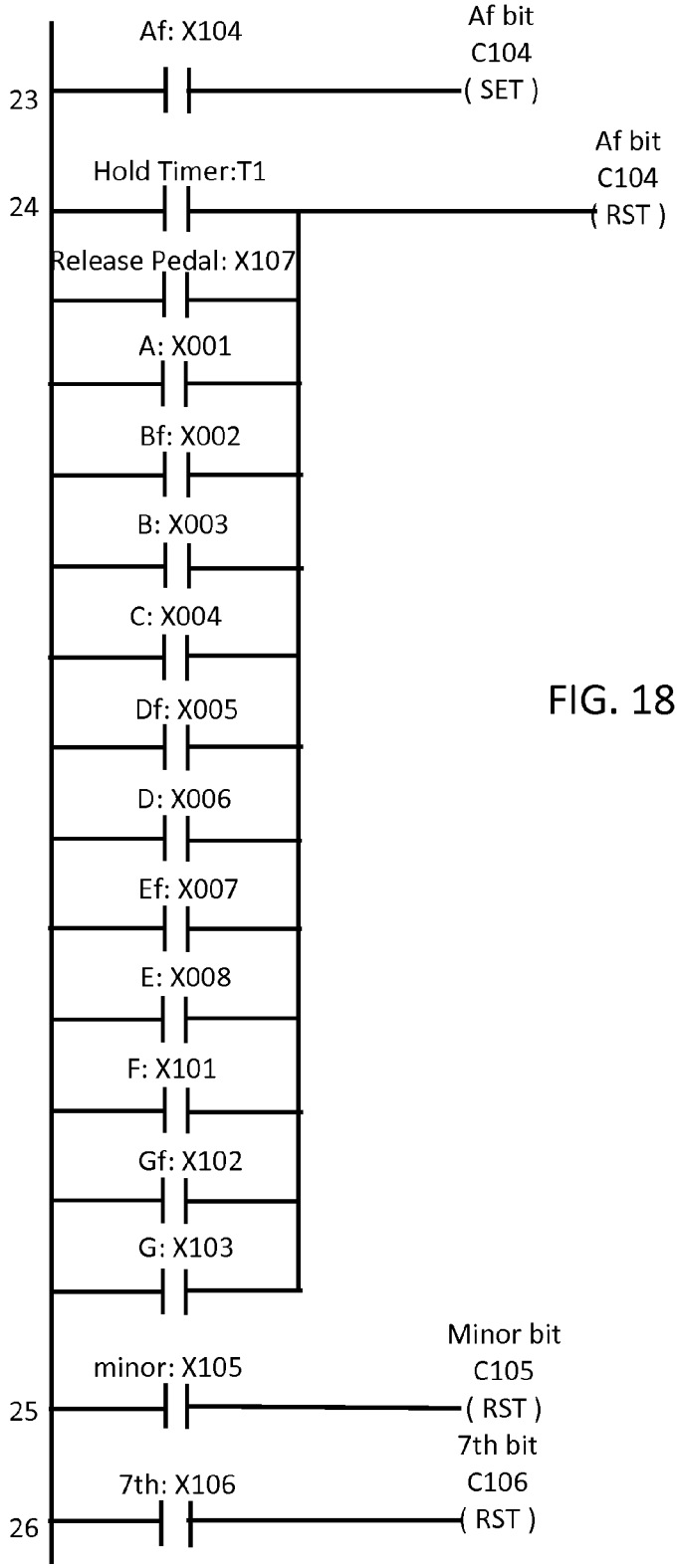
Figure 19:
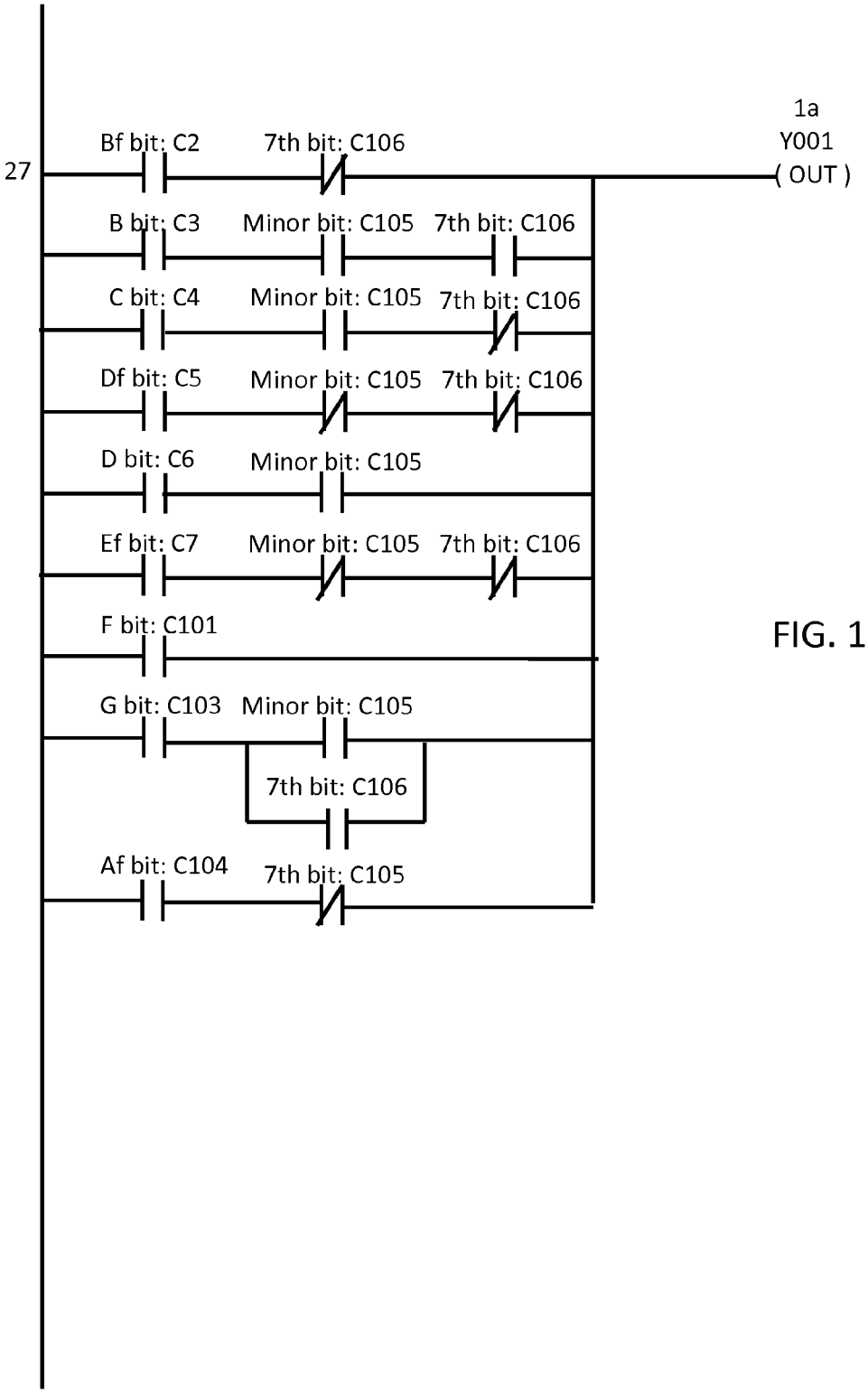
Figure 20:
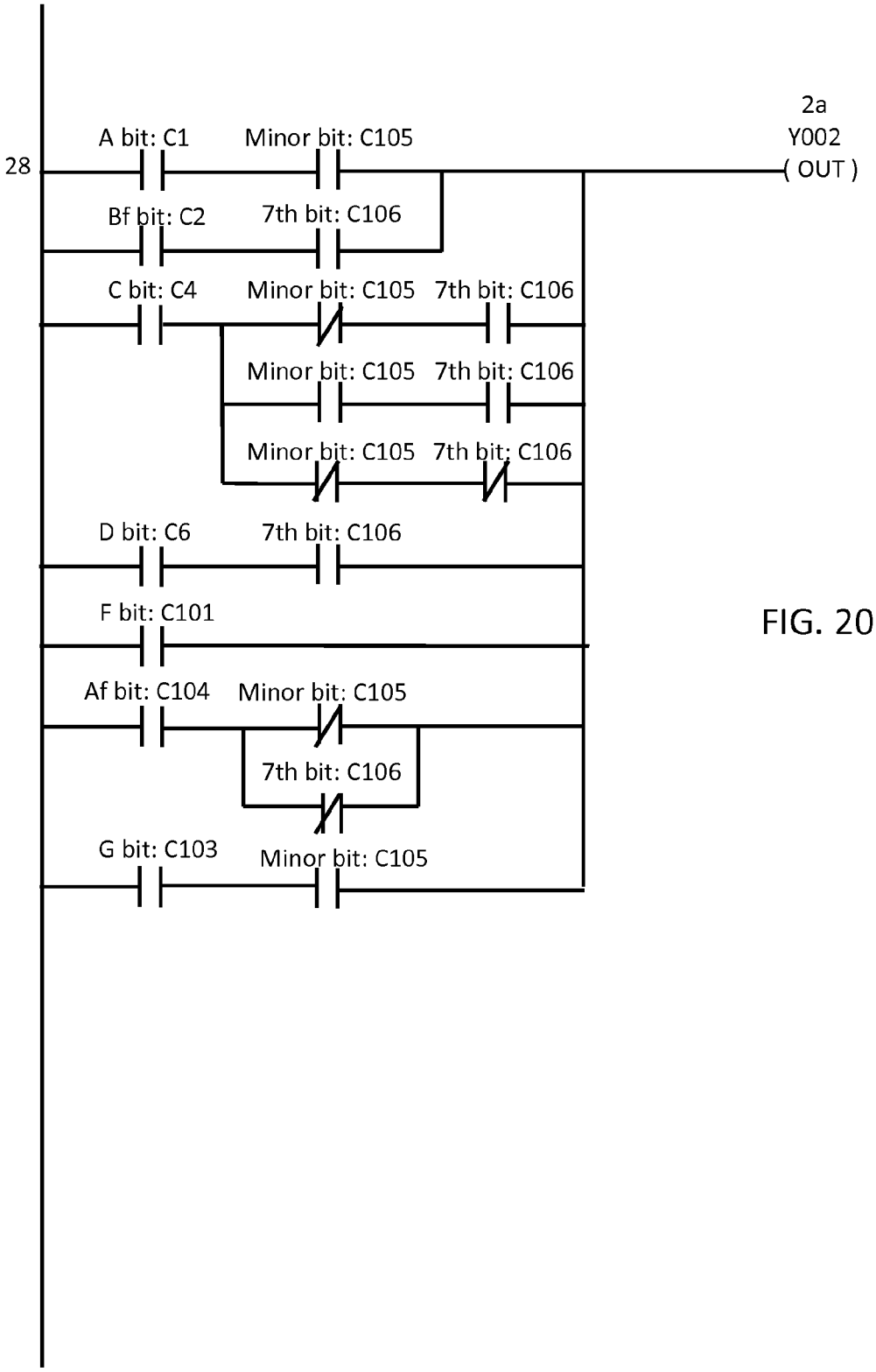
Figure 21:
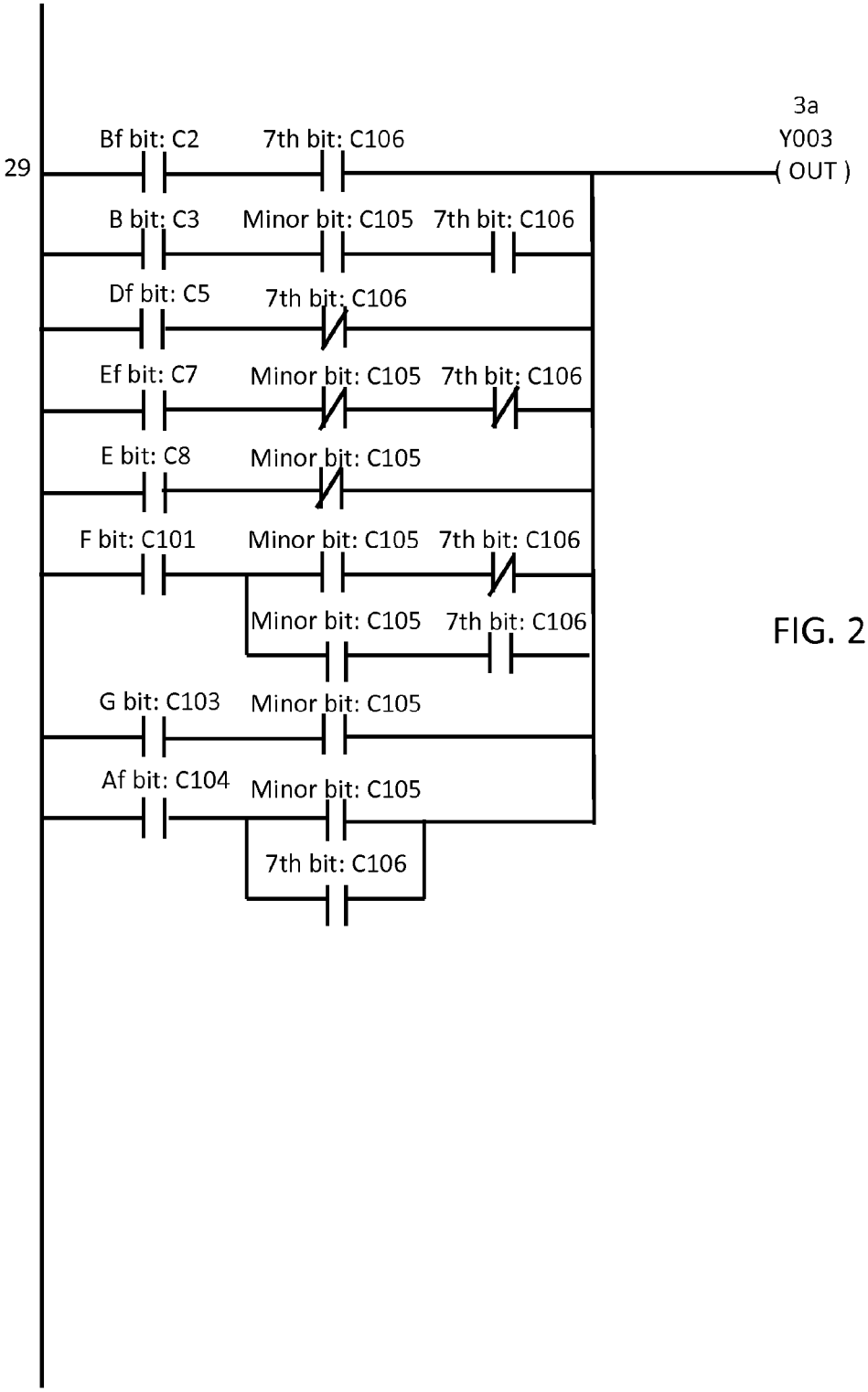
Figure 22:
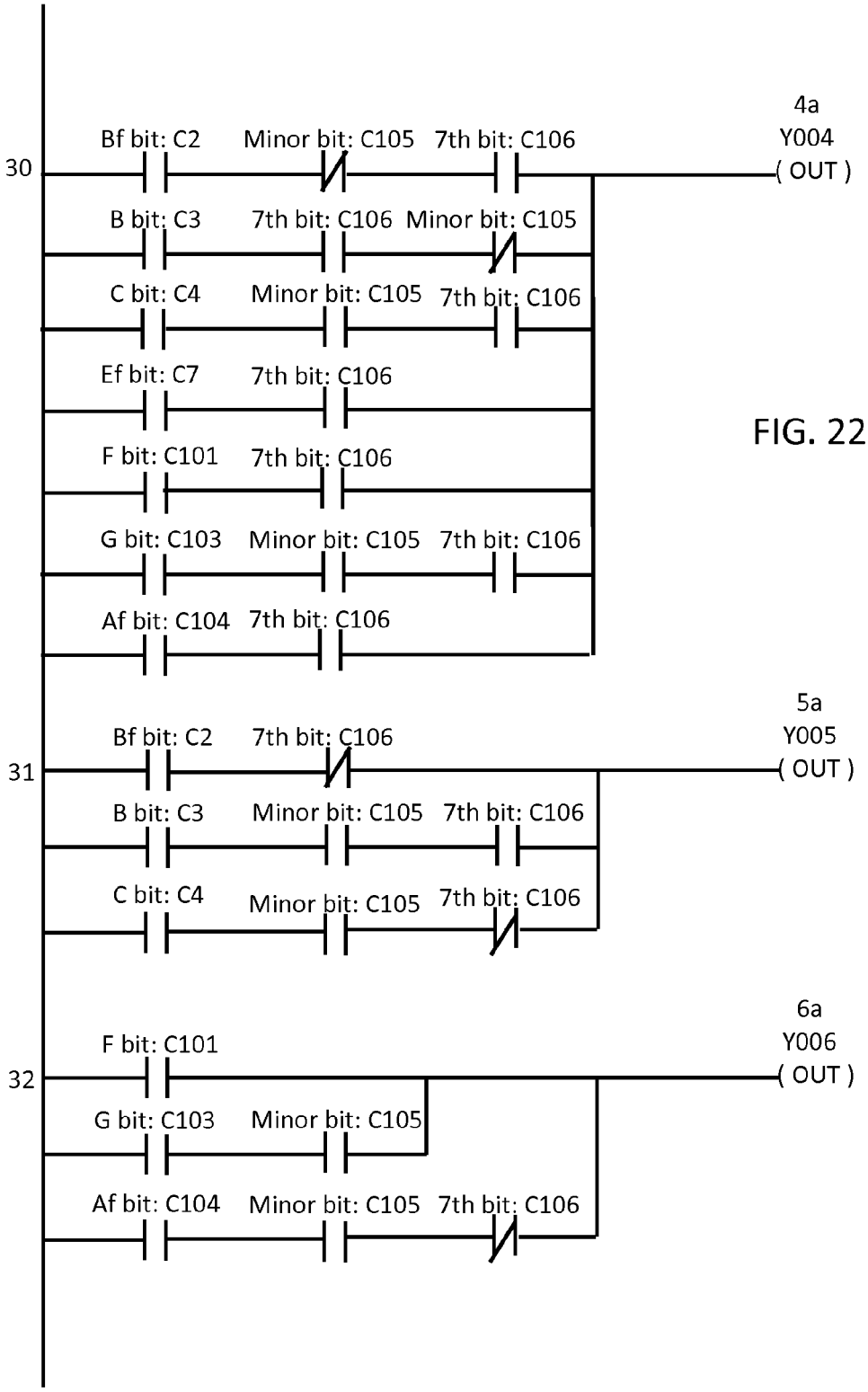
Figure 23:
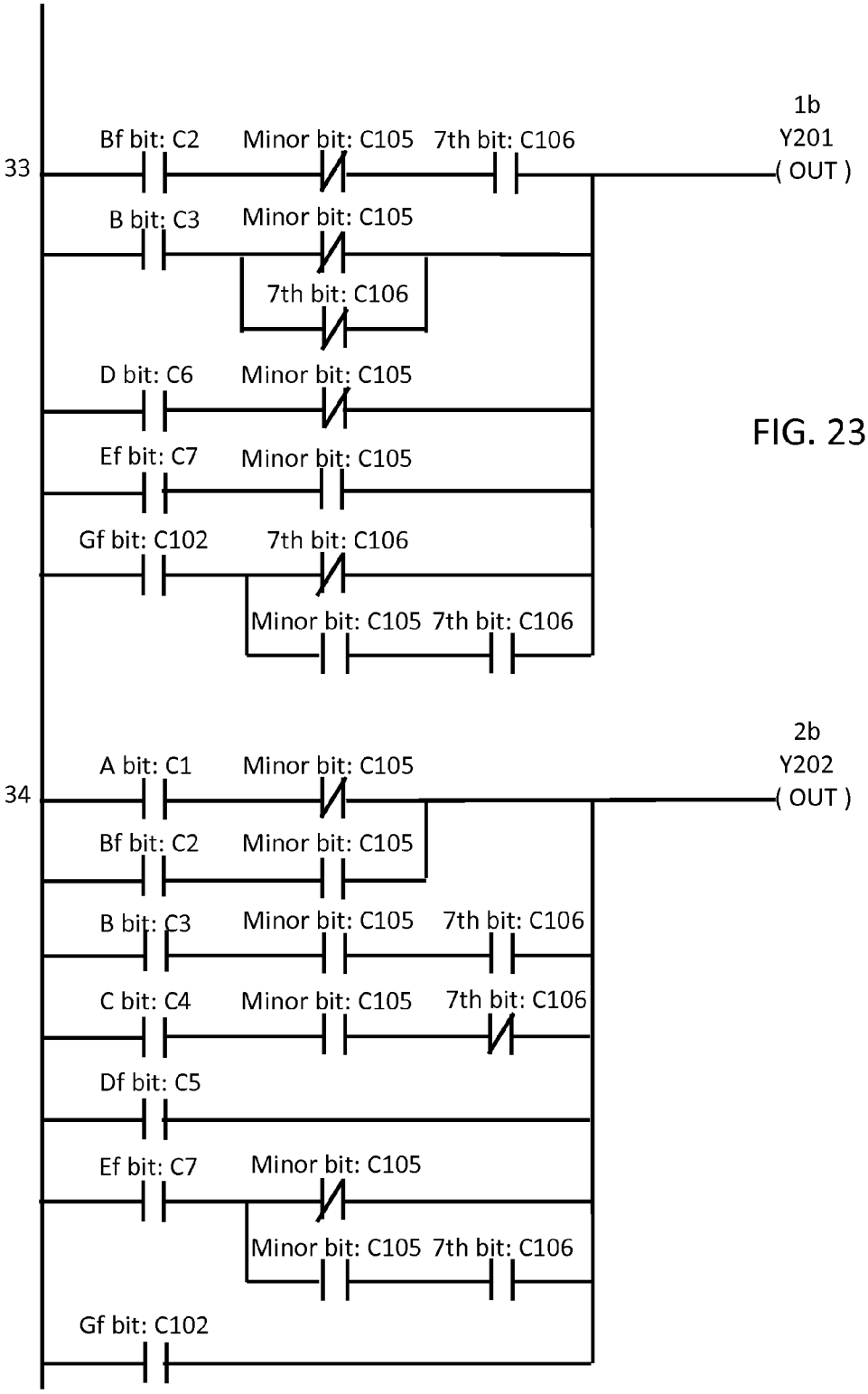
Figure 24:
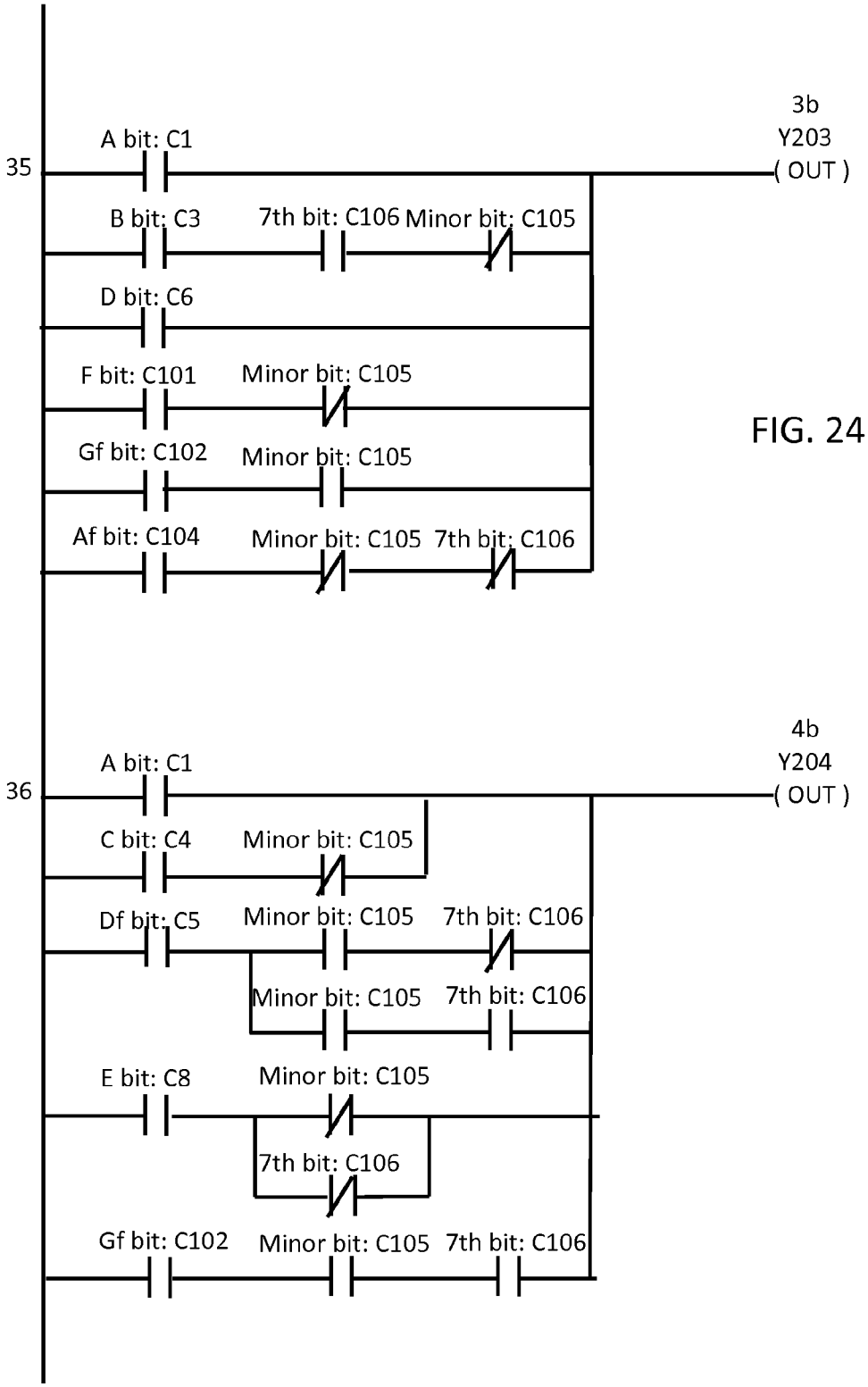
Figure 25:
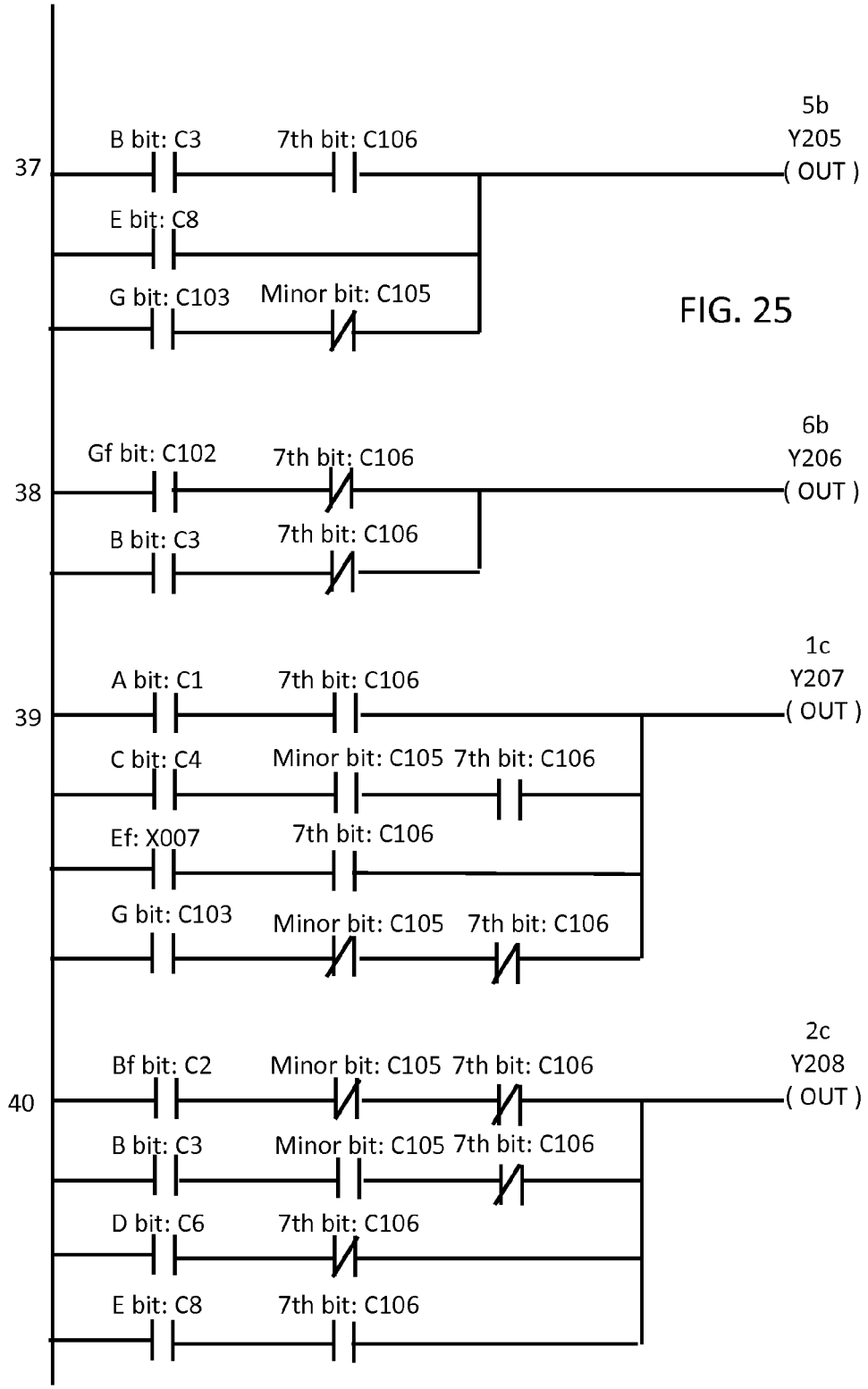
Figure 26:
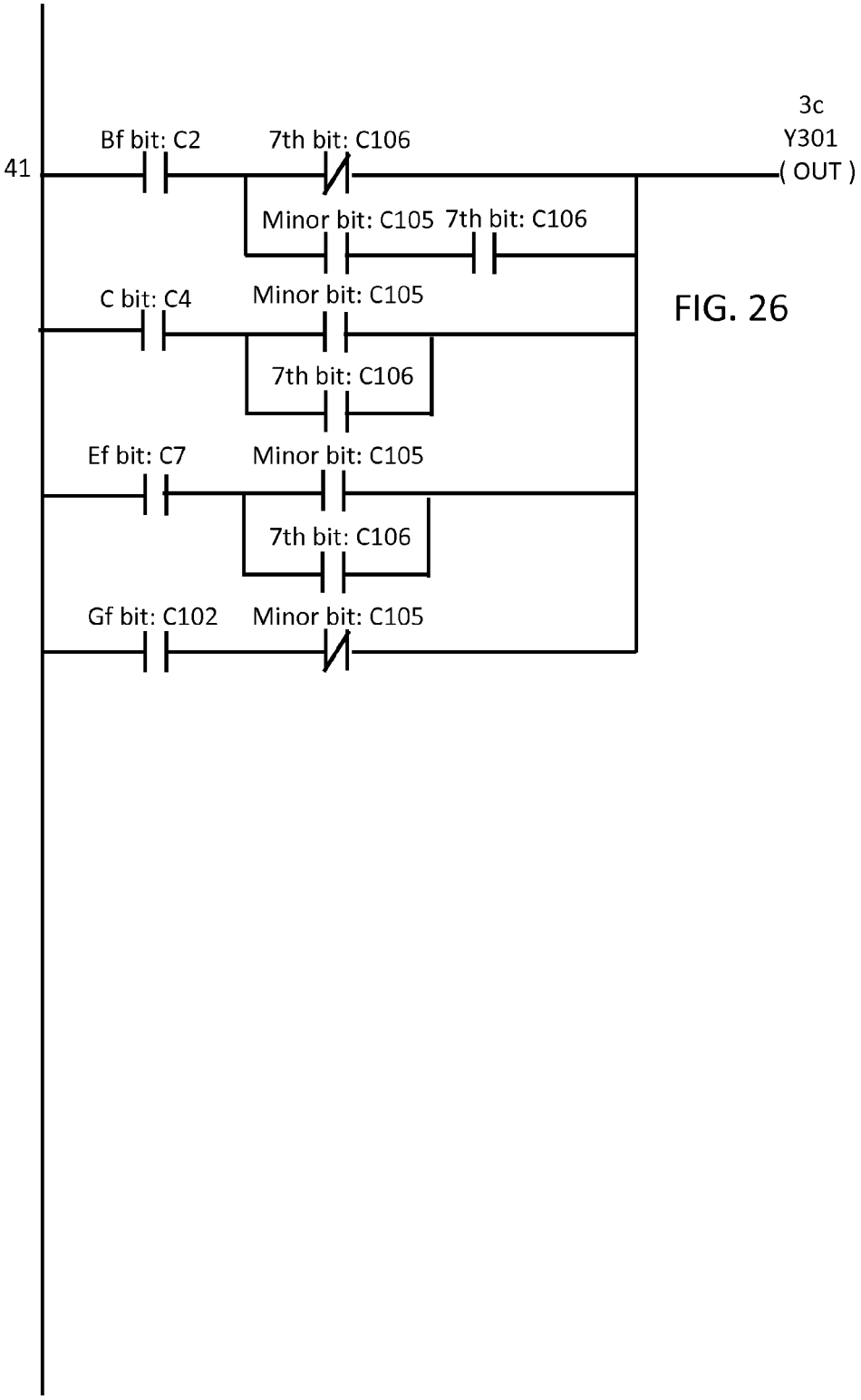
Figure 27:
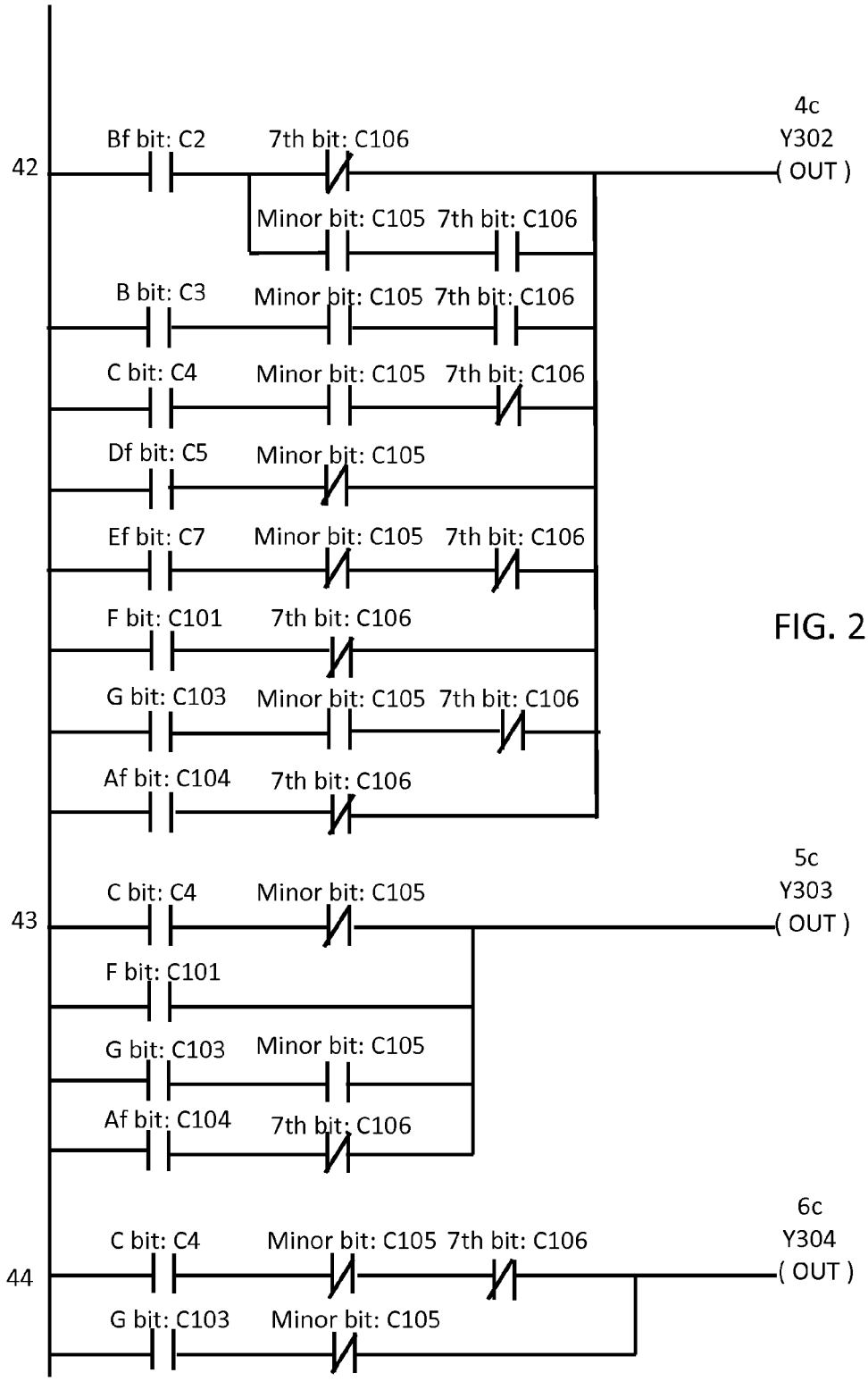

Comparing the apparatus of FIG. 1 with the logic of FIGS. 18-19, depressing minor toggle 30 or $7^{th}$ toggle 32 activates minor bit C105 or $7^{th}$ bit C106, respectively. Other toggles for other chord variations, e.g., diminished or augmented chords, may be used to activate other bits.

Turning to FIGS. 19-27, a diagrammatic representation of logic used to resolve chords is shown. For example, in FIG. 19, at entry "27," if the logic of any of the nine rungs is determined to be true, an output may be activated, which may correspond to sending a signal to energize a certain actuator 50. In this example, the identifier assigned to the actuator, i.e., "1*a*," corresponds to the string and fret combination of the actuator, i.e., it would actuate the actuator overlying the first string ("1") at the first fret or note position ("a").

The slashed contacts may represent bits that preferably are not energized in order to complete the run. For example, the top run in entry "27" indicates that output Y001, representing actuator 1*a*, is activated if bit C2 for a B-flat chord is energized and if bit C106 for the $7^{th}$ chord is not energized.

The control device 24 may proceed down the left side of the ladder to continually check to see if it can complete a path across any additional rungs. Exemplary additional decision points are shown at entries "28" through "45," although other decision points are possible.

If so, those additional actuators may be energized, depressing all of the actuators necessary to play a desired chord.

Figure 28:
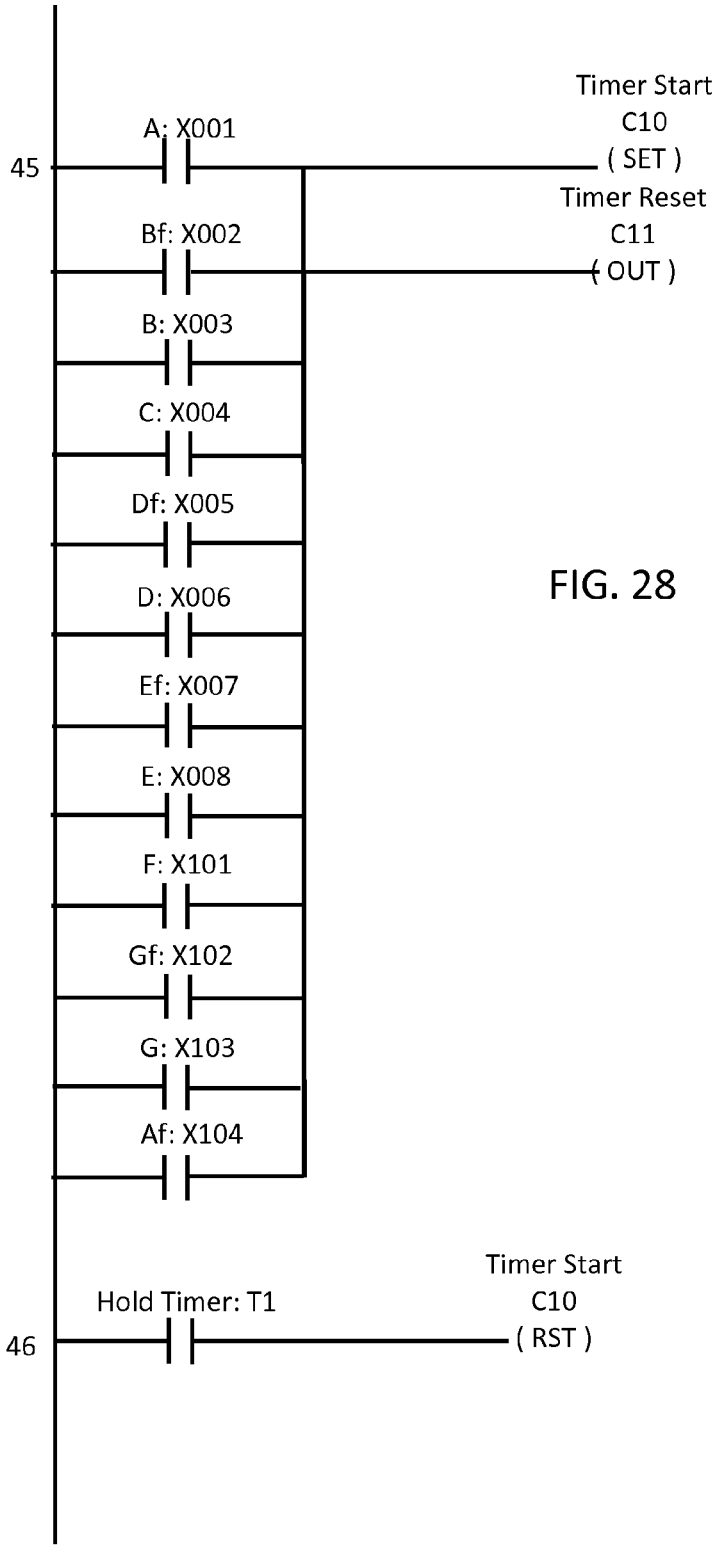
Figure 29:
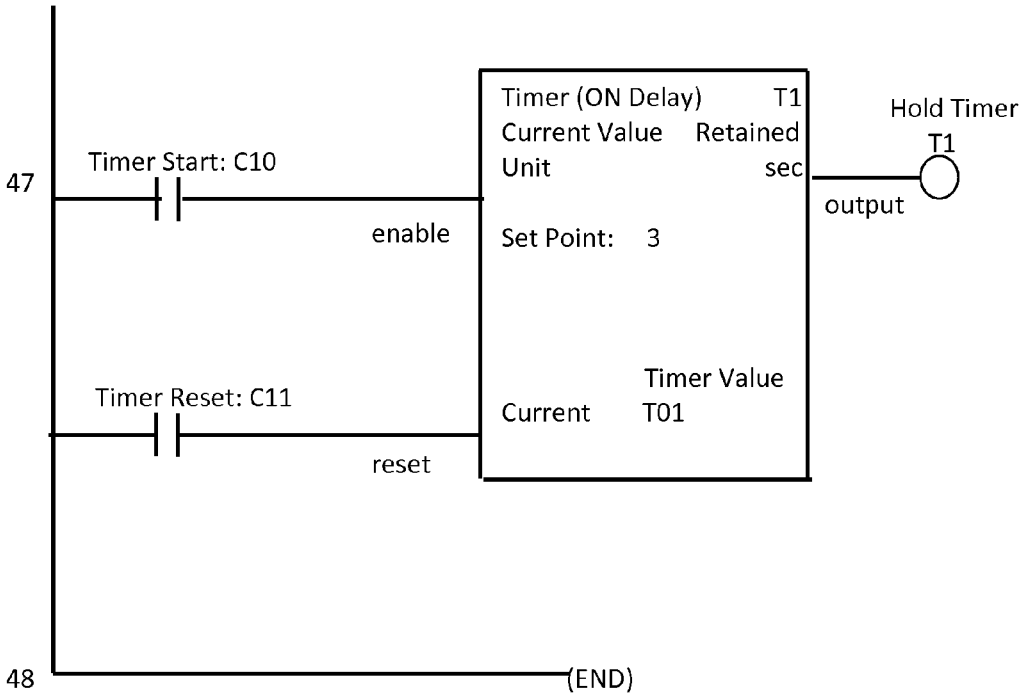

Turning now to FIGS. 28-29, logic relating to the chord latching feature is shown. At entry "45," selecting any pedal may energize timer start bit C10. Any subsequent pedal selection then may energize timer reset bit C11.

At entry "47," the energizing of timer start bit C10 or timer reset bit C11 may lead the control device 24 to set the latch timer at a predetermined length of time, e.g., here, three seconds, and continually monitor the length of time latched versus this set point. As long as the current time is less than or equal to the predetermined length of time, hold timer T1 is energized.

Returning to the earlier rungs of the ladder logic, it will be seen that energizing T1 is one way in which bits C1-C8 and C101-104 may be energized. Thus, as long as T1 is energized, the bits may be energized, leading to the necessary actuators being energized, thereby latching the chord until it is reset.

In this manner, an apparatus is constructed that may permit a user to play a stringed instrument with only one hand, i.e., performing the fretting or string selection that one hand traditionally performs. Such an apparatus my be particularly useful to individuals that do not have the use of two hands, e.g., accident victims, wounded military personnel, individuals with palsy, or individuals with nerve damage or localized paralysis.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

I claim:

1. A device for depressing the strings of a stringed musical instrument, comprising:

a foot-operated pedal portion; and a hands-free string-engaging portion operatively coupled to the pedal portion;

the pedal portion comprising a plurality of pedals, each pedal representing a note in a chromatic scale and arranged chromatically with respect to the other pedals;

the string-engaging portion comprising a plurality of actuators, the actuators arranged so as to overlie a series of half-step positions on each string of the stringed musical instrument;

wherein the device is configured such that depressing one of the pedals causes the actuators corresponding to a predetermined chord to be depressed.

2. The device of claim 1, further comprising a second foot-operated portion.

3. The device of claim 2, wherein the second foot-operated portion includes toggle buttons to alter the predetermined chord.

4. The device of claim 3, wherein the predetermined chord is a major chord and one of the toggle buttons alters the predetermined chord to a $7^{th}$ chord.

5. The device of claim 3, wherein the predetermined chord is a major chord and one of the toggle buttons alters the predetermined chord to a diminished chord.

6. The device of claim 1, the pedal portion further including a control device configured to translate pedal inputs into signals to one or more of the plurality of actuators.

7. The device of claim 1, the pedal portion including an additional pedal; wherein the device is configured such that depressing one of the plurality of pedals causes a predetermined set of actuators to be energized and locked in place; and further wherein the device is configured such that depressing the additional pedal releases the locked actuators.

8. The device of claim 1, wherein the actuators are linear actuators.

9. A device for depressing the strings of a stringed musical instrument, comprising:

a foot-operated pedal portion including a plurality of pedals operatively coupled to a control device, the pedals arranged chromatically, and each pedal representing a major chord;

a second foot-operated portion including one or more toggles for modifying the major chords; and a hands-free string-engaging portion operatively coupled to the pedal portion, comprising a plurality of actuators configured to overlie a series of half-step positions on each string of the stringed musical instrument;

wherein the device is configured such that depressing one of the pedals causes the actuators corresponding to a predetermined chord to be depressed.

10. The device of claim 9, wherein the control device comprises a microprocessor.

11. The device of claim 9, wherein the control device comprises a programmable logic controller.

12. The device of claim 9, the pedal portion further comprising a sensor operatively coupled proximate a proximal end of each of the plurality of pedals.

13. The device of claim 12, wherein the sensor is a potentiometer.

14. The device of claim 9, the pedal portion including an additional pedal; wherein the device is configured such that depressing one of the plurality of pedals causes a predetermined set of actuators to be energized and locked in place; and further wherein the device is configured such that depressing the additional pedal releases the locked actuators.

15. The device of claim 9, wherein the toggles permit modification to at least one of a minor chord, a $7^{th}$ chord, a diminished chord, and an augmented chord.

16. A device for depressing the strings of a stringed musical instrument, comprising:

a foot-operated pedal portion including a plurality of pedals operatively coupled to a control device, the pedals arranged chromatically, and each pedal corresponding to a major chord;

a second foot-operated portion including one or more toggles for modifying the major chords; and a hands-free string-engaging portion operatively coupled to the pedal portion, comprising a plurality of actuators configured to overlie a series of half-step positions on each string of the stringed musical instrument;

wherein the pedal portion further includes a control device operably coupled to and configured to receive input signals from the pedals and the one or more toggles;

wherein the control device is operably coupled to and configured to send output signals to the plurality of actuators; and wherein the device is configured such that depressing one of the pedals causes the actuators corresponding to a predetermined chord to be depressed.

* * * * *